US010823161B2

(12) United States Patent
Indruk

(10) Patent No.: US 10,823,161 B2
(45) Date of Patent: Nov. 3, 2020

(54) FOAM PUMP AND DISPENSER EMPLOYING SAME

(71) Applicant: Gregory L. Indruk, Nashua, NH (US)

(72) Inventor: Gregory L. Indruk, Nashua, NH (US)

( * ) Notice: Subject to any disclaimer, the term of this patent is extended or adjusted under 35 U.S.C. 154(b) by 184 days.

(21) Appl. No.: 15/806,439

(22) Filed: Nov. 8, 2017

(65) Prior Publication Data

US 2018/0058445 A1 Mar. 1, 2018

Related U.S. Application Data

(63) Continuation-in-part of application No. 15/099,918, filed on Apr. 15, 2016, now Pat. No. 10,359,031.

(60) Provisional application No. 62/160,057, filed on May 12, 2015.

(51) Int. Cl.

| | |
|---|---|
| ***F04B 13/02*** | (2006.01) |
| ***F04B 19/22*** | (2006.01) |
| ***F04B 19/06*** | (2006.01) |
| ***F04B 15/00*** | (2006.01) |
| ***F04B 9/14*** | (2006.01) |
| ***F04B 53/12*** | (2006.01) |

(Continued)

(52) U.S. Cl.

CPC ..... *F04B 13/02* (2013.01); *F04B 9/14* (2013.01); *F04B 15/00* (2013.01); *F04B 19/06* (2013.01); *F04B 19/22* (2013.01); *F04B 53/126* (2013.01); *F04B 1/0439* (2013.01); *F04B 53/1005* (2013.01)

(58) Field of Classification Search

CPC .. F04B 9/14; F04B 13/02; F04B 15/00; F04B 19/06; F04B 19/16; F04B 7/0266–0275; F04B 9/02; F04B 23/025–028; F04B 33/00; F04B 53/12; F04B 53/123–129; B05B 7/0018; B05B 7/005–0062; B05B 11/3087

USPC .... 222/190, 282, 288, 372, 380, 383.1, 385; 417/374, 430, 503, 554, 555.1, 567

See application file for complete search history.

(56) References Cited

U.S. PATENT DOCUMENTS 3,207,378 A * 9/1965 Trumbull ..... G01F 11/021 222/134

4,018,545 A * 4/1977 Knedlik ..... A23G 9/045 417/262

(Continued)

*Primary Examiner* — Alexander B Comley

(74) *Attorney, Agent, or Firm* — McLane Middleton, Professional Association

(57) ABSTRACT

A foam pump for generating a foam including a foamable liquid and air has dual, coaxial air and liquid cylinders, each having a respective air and liquid piston which move together during a dispensing operation. In certain embodiments, the air and liquid cylinders are modular, separately formed components. In certain embodiments, a plurality of differently sized, liquid cylinders are provided, each with a corresponding liquid piston which is complementary in size thereto. Providing multiple differently sized liquid cylinder and piston components allows the pump to be configured to deliver a desired quantity of foamable liquid and/or a desired liquid-to-air ratio in the foam output of the pump. The differently sized liquid cylinder and piston components can be used interchangeably with a common air cup design and other common pump components, the modular construction allowing custom pump output configurations to be provided with minimal tooling investment per output size.

29 Claims, 27 Drawing Sheets

(51) Int. Cl.
*F04B 1/0439* (2020.01)
*F04B 53/10* (2006.01)

(56) References Cited

U.S. PATENT DOCUMENTS 4,053,089 A * 10/1977 Gamadia ..... B05B 11/3035 222/207
5,255,851 A * 10/1993 Tobler ..... B05B 7/0037 222/190
5,271,530 A * 12/1993 Uehira ..... B05B 7/0037 222/190
5,335,734 A * 8/1994 Scott ..... A62C 11/00 169/15
5,443,569 A * 8/1995 Uehira ..... B05B 7/0031 222/190
5,570,606 A 11/1996 Irie
6,053,364 A * 4/2000 van der Heijden ..... B05B 11/3087 222/145.6
6,082,586 A * 7/2000 Banks ..... A47K 5/14 222/95
6,612,468 B2 * 9/2003 Pritchett ..... B05B 7/0037 222/190
7,641,077 B2 * 1/2010 Law ..... B05B 7/0025 222/137
7,661,561 B2 * 2/2010 Ophardt ..... B05B 7/0037 222/1
7,850,049 B2 12/2010 Ciavarella et al.
8,393,500 B2 3/2013 Mizushima et al.
8,490,833 B2 7/2013 van der Heijden
8,499,981 B2 * 8/2013 Quinlan ..... A47K 5/14 222/136
8,534,505 B2 * 9/2013 Romanin ..... B05C 5/0225 222/250
8,561,919 B2 * 10/2013 Wang ..... B05B 7/0037 222/145.5
8,591,207 B2 11/2013 Ciavarella
9,596,963 B2 3/2017 Harris et al.
2008/0083784 A1 * 4/2008 Foster ..... B05B 11/3001 222/153.13
2009/0294478 A1 * 12/2009 Ciavarella ..... A47K 5/14 222/190
2014/0034679 A1 * 2/2014 Fitzpatrick ..... A47K 5/16 222/190
2014/0091106 A1 * 4/2014 Ophardt ..... A47K 5/1207 222/181.3
2014/0367419 A1 * 12/2014 Harris ..... A47K 5/14 222/190
2015/0136807 A1 * 5/2015 Wang ..... A47K 5/14 222/190
2016/0333874 A1 11/2016 Indruk

* cited by examiner

FOAM PUMP AND DISPENSER EMPLOYING SAME

CROSS REFERENCE TO RELATED APPLICATION

This application is a continuation-in-part of U.S. application Ser. No. 15/099,918 filed Apr. 15, 2016, which, in turn, claims the priority benefit of U.S. provisional application No. 62/160,057 filed May 12, 2015. Each of the aforementioned applications is incorporated herein by reference in its entirety.

BACKGROUND

The present invention relates to an apparatus for dispensing a foam comprising a mixture of a foamable liquid and air. Foam pumps are commonly used to dispense a foamable liquid from a rigid container. In such applications, a foam pump is typically mounted in the neck of a rigid container and employs a dip tube extending from a liquid inlet of the foam pump to the bottom of the container. A manually depressible nozzle is typically attached to the liquid outlet of the foam pump for dispensing the liquid-air mixture. Such foam pumps often employ an air cylinder and a liquid cylinder that are concentrically arranged but axially offset. The axial offset between the liquid cylinder and the air cylinder increases the axial length of the pump. An exemplary, commercially foam engine of this type is described in U.S. Pat. No. 6,053,364, incorporated herein by reference in its entirety.

U.S. Pat. No. 8,336,740 discloses a system and method for adapting such prior art foam pumps for use in a bag-in-box type fluid dispenser. In a bag-in-box dispenser, the fluid reservoir is positioned above the pump and the pump is inverted such that the liquid outlet of the pump is positioned below the liquid inlet of the pump. However, because of the axial offset between the air cylinder and the liquid cylinder, such pumps generally have a high profile and extend into the bag containing the liquid to be dispensed. As such, with such pumps, measures must be taken to allow the liquid pump inlet to communicate with the bottom of the fluid reservoir to avoid product waste. The aforementioned U.S. Pat. No. 8,336,740 is incorporated herein by reference in its entirety.

In addition, such fluid reservoirs are typically plastic bags constructed from flexible plastic film, which are configured to allow the pressure within the bag to equalize with the ambient air pressure to avoid the need to vent the fluid reservoir. Such plastic bags are prone to puncture and the prior art high profile pumps extending into the flexible bags are a source of trauma to the bags during transport and handling.

Furthermore, leakage is of special concern for foam pumps that are employed in an inverted orientation. In such inverted applications, the fluid source is located above the pump. Thus, if the pump piston were to stick or liquid outlet valve were to otherwise fail, catastrophic leakage could occur resulting in not only product waste but also a potentially hazardous condition, e.g., should the liquid product leak onto the floor.

The present disclosure contemplates a new and improved foam pump and dispenser which overcome the above-referenced problems and others.

SUMMARY

In one aspect, a foam pump comprises a dual air and liquid cylinder including a base wall having a central opening therein defining a liquid inlet; an inner annular wall extending from the base wall and surrounding the central opening and having an open end opposite the base wall; and an outer annular wall extending from the base wall and surrounding the inner annular wall and having an open end opposite the base wall. A dual air and liquid piston assembly is received in the dual air and liquid cylinder, the dual air and liquid piston assembly including an air piston member including an air piston ring slidably engaging an inner surface of the outer annular wall, the air piston member cooperating with the outer annular wall to define a collapsible air chamber for receiving air; a liquid piston assembly including a liquid piston ring supported on a liquid piston shaft, the liquid piston ring slidably engaging an inner surface of the inner annular wall, the liquid piston cooperating with the inner annular wall to define a collapsible liquid chamber for receiving a foamable liquid; and the liquid piston shaft having a first end axially adjacent the collapsible liquid chamber, a second end defining a liquid outlet, and a central passageway extending between the first end and the second end, the second end of the liquid piston shaft attached to the air piston member to move therewith. A liquid inlet valve member is received within the central opening for regulating flow through the liquid inlet and a liquid outlet valve is received within the second end of the liquid piston shaft for regulating flow through the liquid outlet. The dual air and liquid piston assembly includes a mixing chamber downstream of the liquid outlet, the mixing chamber being in fluid communication with the collapsible liquid chamber through the liquid outlet valve. The mixing chamber is in fluid communication with the collapsible air chamber through a plurality of air passageways between the air piston member and the liquid piston shaft, wherein each of the air passageways is configured to impart a rotational flow to air entering the mixing chamber. A biasing member urges the piston assembly to a non-actuated position, wherein the foam pump is actuatable by urging the piston assembly against the biasing member to an actuated position in which the collapsible air chamber and the collapsible liquid chamber are reduced in volume such that air is expelled from the collapsible air chamber and through the plurality of channels into the mixing chamber while at the same time foamable liquid is expelled from the collapsible liquid chamber through the central passageway with simultaneous movement of the air and the foamable liquid into the mixing chamber causing a turbulent mixing thereof in the mixing chamber of the foam pump.

In another aspect, a foam pump assembly including the foam pump apparatus in accordance with this disclosure and a container containing a foamable liquid is provided.

In yet another aspect, a dispensing apparatus for dispensing a foamable liquid is provided.

In still another aspect, a foam pump apparatus comprises a dual air and liquid cylinder assembly including an air cup having a base wall and an outer annular wall extending from the base wall, the outer annular wall having an open end opposite the base wall. The dual air and liquid cylinder further includes a liquid cup having a proximal end, an inner annular wall extending from the proximal end, and a distal end opposite the proximal end, the distal end being open, the liquid cup and the air cup being separately formed, and the proximal end configured to be attached to a complementary fastener element on the base wall to coaxially secure the liquid cup within the air cup. A first aligned opening in the base wall and a second aligned opening in the proximal end cooperate to define a liquid inlet and a first liquid check valve regulates a flow of foamable liquid from a liquid source to the liquid cup. A dual air and liquid piston assembly is received in the dual air and liquid cylinder. The dual air and liquid piston assembly includes an air piston member including an air sealing surface slidably engaging an inner surface of the outer annular wall, the air piston member cooperating with the base wall and the outer annular wall to define an air chamber for receiving air. The air chamber is selectively collapsible in response to relative movement between the dual air and liquid piston assembly and the dual air and liquid cylinder assembly in a first axial direction and expandable in response to relative movement between the dual air and liquid piston assembly and the dual air and liquid cylinder assembly in a second axial direction. A liquid piston member includes a liquid sealing surface slidably engaging an inner surface of the inner annular wall, and cooperates with the proximal end and the inner annular wall to define a liquid chamber for receiving a foamable liquid. The liquid chamber is selectively collapsible in response to relative movement between the dual air and liquid piston assembly and the dual air and liquid cylinder assembly in the first axial direction and expandable in response to relative movement between the dual air and liquid piston assembly and the dual air and liquid cylinder assembly in the second axial direction. The liquid piston member includes a first end defining a liquid piston inlet and a second end defining a liquid piston outlet, and a central passageway extending between the first end and the second end. The liquid piston member is attached to the air piston member to move together therewith. A second liquid check valve regulates a flow of the foamable liquid through the central passageway. The dual air and liquid piston assembly includes a mixing region downstream of the liquid piston outlet, wherein the mixing region is in fluid communication with the liquid chamber when the second liquid check valve is in an open position. The mixing region is in fluid communication with the air chamber through one or more air passageways extending between the air piston member and the liquid piston member. A biasing member urges the dual air and liquid piston assembly to a non-actuated position and the foam pump is actuatable by urging the piston assembly against the biasing member to an actuated position in which the air chamber and the liquid chamber are reduced in volume such that air is expelled from the air chamber and through the one or more air passageways into the mixing region while at the same time foamable liquid is expelled from the liquid chamber through the central passageway, wherein simultaneous movement of the air and the foamable liquid into the mixing region is configured to cause a turbulent mixing thereof in the mixing region.

In a more limited aspect, the proximal end of the liquid cup is removably attached to the fastener element on the base wall of the air cup.

In another more limited aspect, the fastener element comprises a receptacle formed on the base wall configured to receive the proximal end of the liquid cup.

In another more limited aspect, the foam pump apparatus further comprises one or more alternate liquid cups, wherein the one or more alternate liquid cups are interchangeably attachable to the fastener element in place of the liquid cup.

In another more limited aspect, at least one of the one or more alternate liquid cups has a volume which different from a volume of the liquid cup.

In another more limited aspect, the foam pump apparatus further comprises one or more alternate liquid piston members wherein each of the one or more alternate liquid piston members is attachable to a corresponding one of the one or more alternate liquid cups.

In another more limited aspect, the foam pump apparatus further comprises one or more air inlet openings formed in the air piston member and an air check valve member having a first sealing element selectively engaging the one or more air inlet openings. The first sealing element is configured to permit ambient air to flow into the air chamber during a fill portion of a dispensing cycle when the air chamber is expanding and to prevent ambient air from flowing into the air chamber through the one or more air inlet openings during a dispensing portion of a dispensing cycle when the air chamber is collapsing.

In another more limited aspect, the air check valve member further includes a second sealing element selecting engaging the liquid piston member. The second sealing element is configured to permit air within the air chamber to flow through the plurality of passageways into the mixing region during the dispensing portion of the dispensing cycle when the air chamber is collapsing and to prevent ambient air from flowing into the air chamber the plurality of air passageways during the fill portion of a dispensing cycle when the air chamber is expanding.

In another more limited aspect, the plurality of air passageways is configured to impart a rotational flow to air entering the mixing region.

In another more limited aspect, the liquid chamber has an axial extent which does not extend beyond an axial extent of the air chamber.

In another more limited aspect, the biasing member is a coil spring surrounding the inner annular wall having a first end engaging the base wall and a second end opposite the first end engaging the dual air and liquid piston assembly.

In another more limited aspect, the first liquid check valve member is configured to close responsive to increased pressurization of the liquid chamber during a dispensing portion of a dispensing cycle and to open responsive to decreased pressurization of the liquid chamber during a fill portion of a dispensing cycle. The second liquid check valve member is configured to open responsive to increased pressurization of the liquid chamber during a dispensing portion of a dispensing cycle and to close responsive to decreased pressurization of the liquid chamber during a fill portion of the dispensing cycle.

In another more limited aspect, the foam pump apparatus further comprises a container containing a foamable liquid, the container in fluid communication with the first liquid check valve.

In another more limited aspect, the second liquid check valve includes a captured ball biased by a spring to close the liquid outlet, the ball configured to move away from a valve seat and thereby open responsive to increased pressurization of the liquid chamber during a dispensing portion of a dispensing cycle.

In another more limited aspect, the foam pump apparatus further comprises a plurality of vanes disposed between the plurality of air passageways and the mixing region, the plurality of vanes configured to impart rotational flow to air entering the mixing region.

In another more limited aspect, the foam pump apparatus further comprises an adapter sleeve defining a central opening and coaxially receiving the dual air and liquid cylinder assembly, the adapter sleeve including an upper end configured to be received within a fitment of a container for the foamable liquid.

In another more limited aspect, the adapter sleeve further comprises an intermediate portion adjacent the upper end, the intermediate portion configured to engage a complementary receptacle within a dispenser housing.

In another more limited aspect, the adapter sleeve further comprises a lower end opposite the upper end, the foam dispensing container further comprising an annular sealing member disposed between an external flange on the dual air and liquid cylinder and the lower end.

In another more limited aspect, the foam pump apparatus further comprises an adapter ring assembly encircling the lower end of the adapter sleeve and the external flange of the dual air and liquid cylinder. The adapter ring includes an upper ring engaging the lower end and a lower ring engaging the external flange, wherein a plurality of connecting arms on the upper ring attach the upper ring to the lower ring. An annular stop extends radially and axially inward of the open end of the dual air and liquid cylinder for limiting the extent of axial movement of the dual air and liquid piston assembly to prevent the dual air and liquid piston assembly from disengaging from the dual air and liquid cylinder.

In another more limited aspect, the foam pump apparatus further comprises one or both of a nozzle and screen member attached to the foam passageway.

In another more limited aspect the foam pump apparatus further comprises a nozzle flange on the nozzle extending radially outwardly.

In another more limited aspect the foam pump apparatus further comprises a spring having a first end bearing against the lower ring of the adapter ring assembly and a second end bearing against the nozzle flange.

In another more limited aspect, the foam pump apparatus further comprises a container containing the foamable liquid, the container having an opening in fluid communication with the liquid inlet.

In another more limited aspect, the foamable liquid is selected from the group consisting of a soap, a shampoo, and a hand sanitizer, a hair mousse, a hair coloring composition, a shaving cream, and a lotion.

In another more limited aspect, the foam pump apparatus further comprises a housing receiving the container and an actuator movably mounted on the housing, the actuator in mechanical communication with the dual air and liquid piston assembly and cooperable therewith to dispense the foamable liquid from the container to a location exterior of the housing responsive to movement of the actuator relative to the housing.

In another more limited aspect, a dual air and liquid cylinder assembly for a foam pump comprises an air cup having a base wall and an outer annular wall extending from the base wall. The outer annular wall has an open end opposite the base wall. A first liquid cup has a proximal end, an inner annular wall extending from the proximal end, and a distal end opposite the proximal end. The distal end is open and the first liquid cup and the air cup are separately formed. The proximal end is configured to be attached to a complementary fastener element on the base wall to coaxially secure the first liquid cup within the air cup. A first aligned opening in the base wall and a second aligned opening in the proximal end cooperate to define a liquid inlet. A liquid check valve regulates a flow of foamable liquid from a liquid source to the first liquid cup.

In another more limited aspect, the dual air and liquid cylinder assembly further comprises a second liquid cup interchangeably attachable to the fastener element in place of the first liquid cup, the second liquid cup having a volume which different from a volume of the first liquid cup.

In another more limited aspect, a method of configuring a foam pump to dispense a dose of foam having a desired size includes a step of providing a dual air and liquid cylinder assembly including an air cup having a base wall and an outer annular wall extending from the base wall, the outer annular wall having an open end opposite the base wall, the base wall having a fastener element for attaching a separately formed liquid cup, the dual air and liquid cylinder assembly being cooperable with a dual air and liquid piston assembly. The separately formed liquid cup is provided, the separately formed liquid cup having a proximal end, an inner annular wall extending from the proximal end, and a distal end opposite the proximal end, the distal end being open, the proximal end configured to be attached to the fastener element on the base wall, wherein the liquid cup is sized hold a preselected quantity of a foamable liquid that is sufficient to generate the dose of foam having the desired size when the foam pump is actuated. The separately formed liquid cup is coaxially secured to the fastener element within the air cup.

One advantage of the present development resides in its improved foam generation due to its spiraling air outlet channels which induce a vortex at the mixing chamber and improve turbulent mixing of the air and foamable liquid.

Another advantage of the present development is found in its use of a liquid outlet valve which is biased to close on its own. In certain embodiments, the liquid outlet valve is formed of a resilient material, such as an elastomeric or other flexible polymer material. In other embodiments, a check valve comprising a ball and spring may be employed. The foam pump in accordance with this disclosure is especially advantageous for use in inverted applications since it does not depend on the return of the pump piston to the non-actuated or home position to shut off flow through the liquid outlet. The self-closing outlet valve of the present disclosure prevents leaking if the foam pump pistons do not return to the fully non-actuated position.

Another advantage of the present development resides in the location of the liquid piston substantially within the air chamber. This lowers the liquid inlet and eliminates the need for an additional component such as a dip tube or dip sleeve to communicate with the bottom of the bag containing the liquid. The lower profile achieved by eliminating or substantially reducing he axial offset between the air chamber and the liquid chamber also eliminates a potential source of bag punctures by reducing the degree to which the foam pump protrudes into the bag reservoir area. Potential fractures in the prior art devices, due to deflection stress, at the junction of the liquid chamber and the air chamber in the prior art foam pumps having an axial offset between the liquid chamber and the air chamber are also avoided in the low foam pumps according to this disclosure.

An advantage of the embodiments herein employing a modular air and liquid cylinder construction is found in that such modular construction allows custom pump output configurations to be provided within a common pump design with minimal tooling investment per output size.

Still further advantages and benefits of the present invention will become apparent to those of ordinary skill in the art upon reading and understanding the following detailed description of the preferred embodiments.

BRIEF DESCRIPTION OF THE DRAWING

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
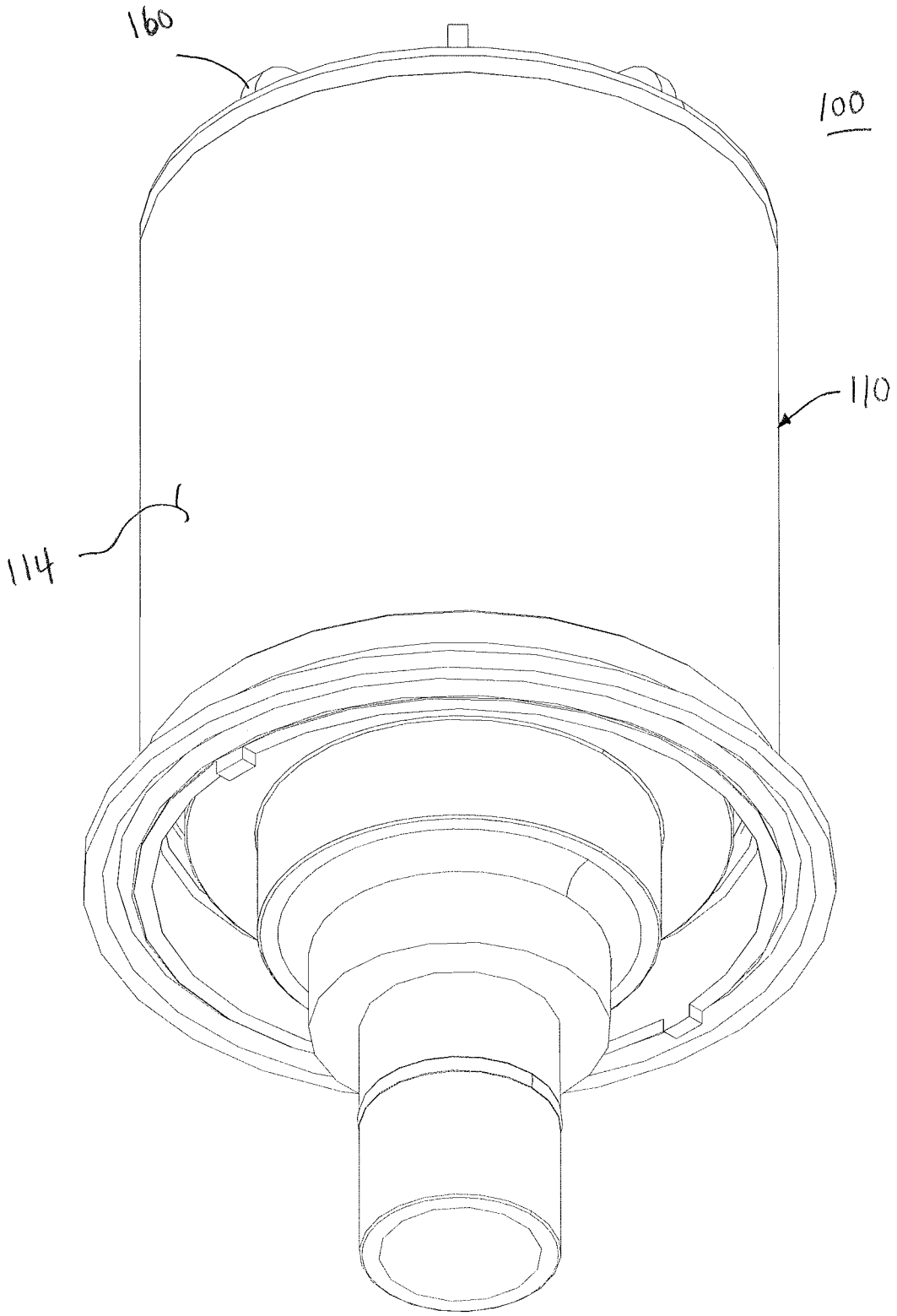
FIG. 1 is an isometric view of a foam pump in accordance with a first exemplary embodiment of the invention, taken generally from below and from the side.
Figure 2:
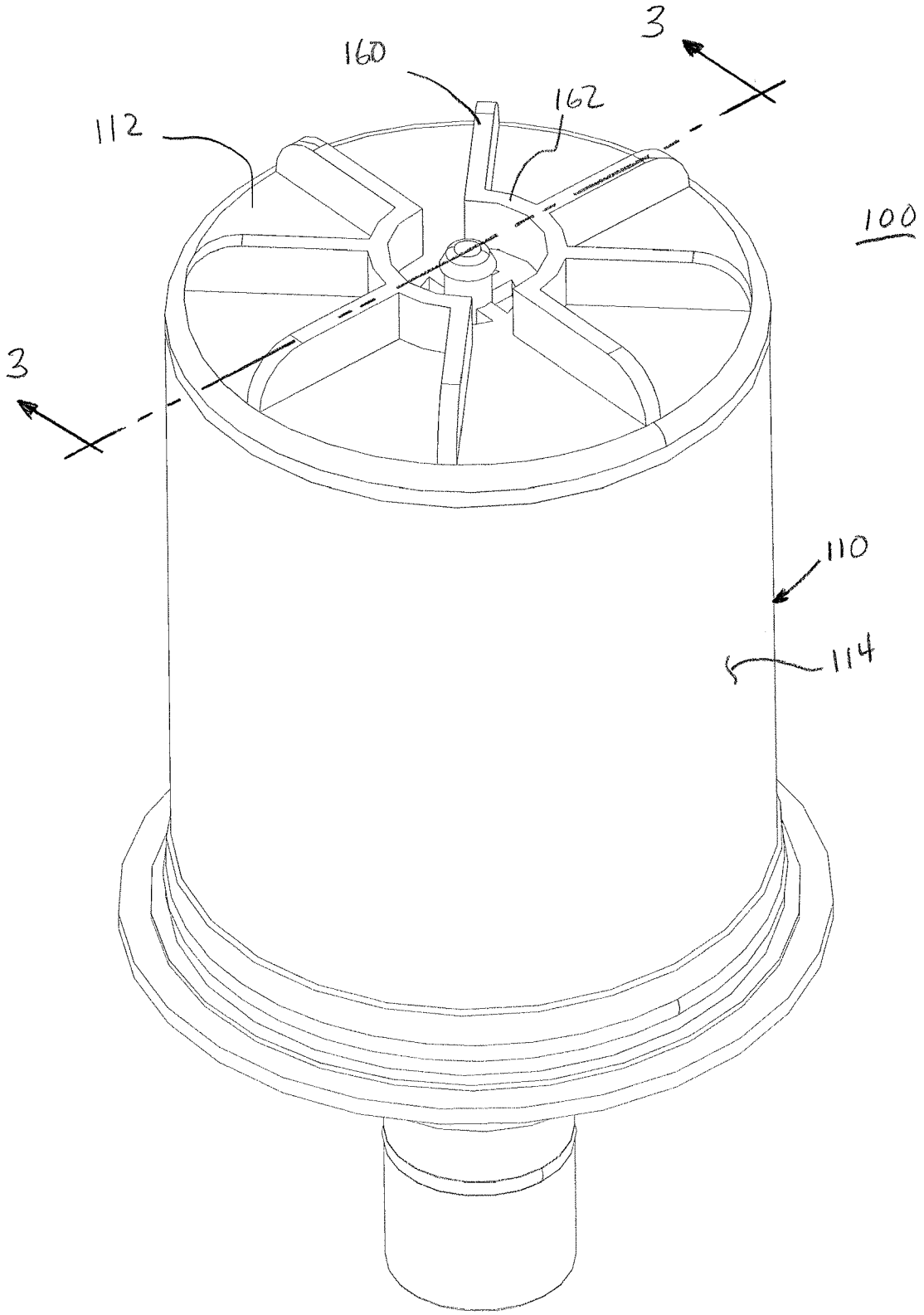
FIG. 2 is an isometric view of the foam pump appearing in FIG. 1, taken generally from above and from the side.

Referring now to the drawings, a FIGS. 1-6 illustrate an exemplary foam pump assembly 100. As used herein, unless specifically stated otherwise, the terms "top," "bottom," "upper," "lower," and other such terms which are dependent on orientation are intended to refer to the orientation of the pump 100 as shown in FIG. 1. The drawings herein depict the foam pump in an orientation wherein the liquid inlet is at located the top and the liquid outlet is located at the bottom. It will be recognized, however, that the presently disclosed pump could also be adapted for use in other orientations. For example, the foam pump assembly 100 could be used in applications wherein it is mounted in the opposite orientation, e.g., in the neck of a rigid dispensing container, such as a counter top or bottle type dispenser, e.g., by employing a dip tube to communicate with the liquid located at the bottom of the container. Likewise, the foam pump assembly herein could be used in a dispenser application wherein the flow axis/direction of piston movement is generally horizontal.

Figure 10:
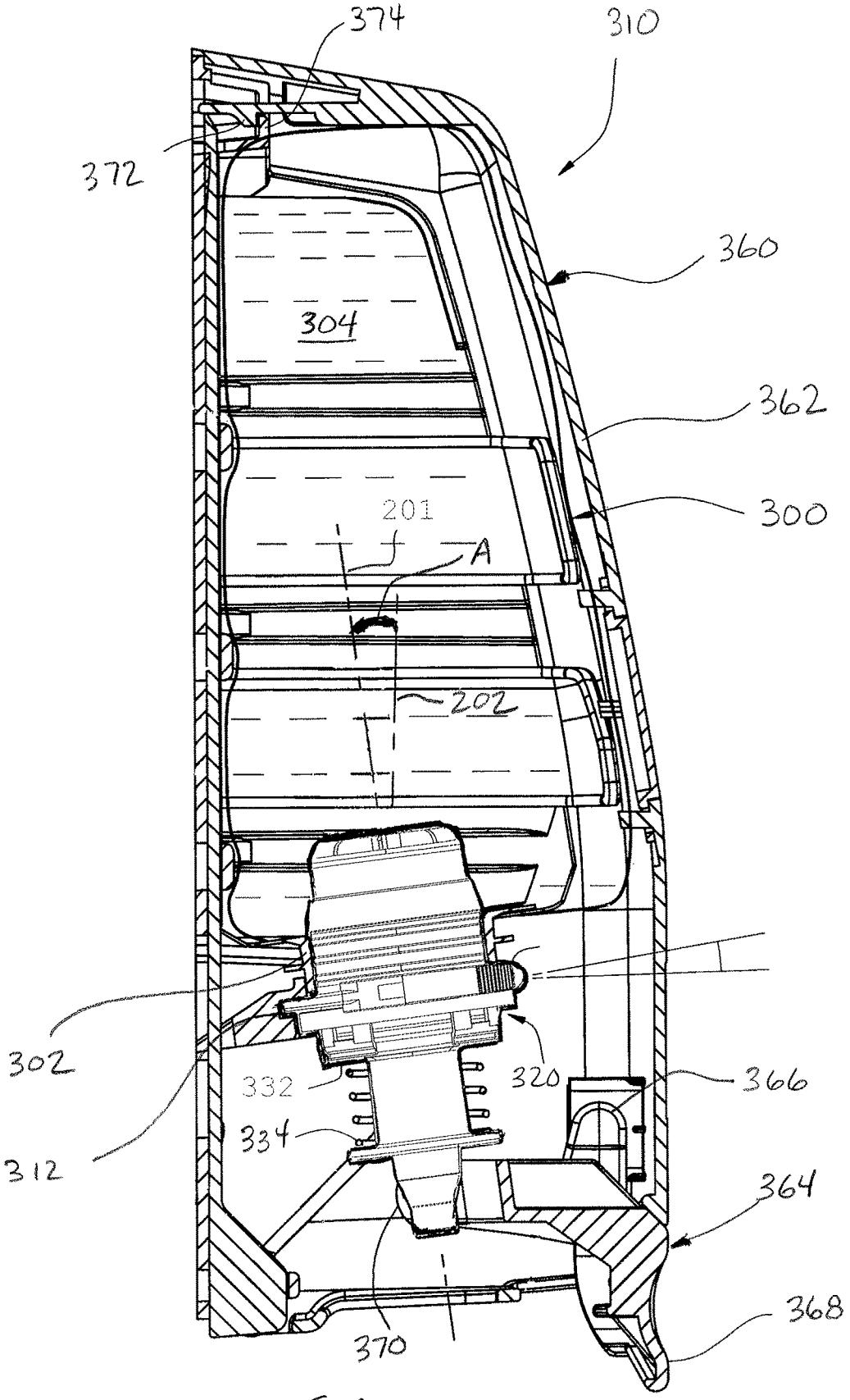
FIG. 10 is a side cross-sectional view showing the foam pump appearing in FIG. 1 within an exemplary dispenser.

In the inverted operational orientation depicted in FIG. 1, the dispensed liquid flows along a generally vertical flow axis 201 (see FIG. 10) such that liquid pump outlet is at a lower vertical position than the liquid pump inlet and the liquid chamber 135 containing the charge of liquid to be dispensed in a subsequent dispensing operation. The term "generally vertical" or "substantially vertical" is not intended preclude deviations of the flow axis from vertical. For example, the pump 100 may be disposed in a dispenser 310 (see FIG. 10) such that the longitudinal axis 201 of the pump 100 is displaced from a vertical axis 202 of the dispenser 310 by an angle A (see FIG. 10). For example, it has been found to be advantageous to configure the dispenser 310 to receive the pump at an angle as seen in FIG. 10, which provides gravitational assistance when installing a pump/bag assembly into the dispenser to ensure that it is properly seated within the dispenser.

The liquids to be dispensed are preferably liquid hygiene products such as hand soaps, facial soaps, shampoos, body soaps, hand sanitizers including waterless hand sanitizers, water-based hand sanitizers, and the like. It will be recognized, however, that other foamable liquids having desirable characteristics when dispensed as a foam are also contemplated, such as hair mousses and foamable hair coloring formulations or compositions, shaving creams, lotions, and the like.

The pump assembly includes a dual air/liquid cylinder 110 having a generally inverted cup-shaped configuration including an upper surface 112 and an annular outer wall 114 extending downward therefrom. The annular outer wall has an inward facing surface 116. The upper surface 112 and the annular outer wall 114 cooperate to define an air chamber or air cylinder 125. The dual cylinder 110 has a lower open end 118 opposite the upper surface 112. An external flange or ridge 120 is disposed at or near the open end 118.

The dual cylinder 110 also includes an inner annular wall 130 extending downward from the upper surface which is concentric with respect to the outer annular wall 114. The inner annular wall 130 has an inward facing surface 132. The inner annular wall 130 defines a liquid cylinder or chamber 135. In the illustrated preferred embodiment, the liquid chamber does not extend beyond the axial extent of the air chamber. Because the liquid chamber does not protrude from the air chamber, a low profile pump can be provided, which is especially advantageous for inverted applications where the container or reservoir containing the liquid is positioned above the pump and it is desirable for the liquid pump inlet to communicate with the liquid located at or near the bottom of the container or reservoir.

A coaxial spring 126, e.g., a coil spring in the illustrated embodiment, is received within the air chamber 125 and surrounds the inner annular wall 130. The upper end of the spring is received within a spring seat defined by the upper surface 112 and an intermediate annular wall 128 coaxially disposed intermediate the inner annular wall 130 and the outer annular wall 114.

An aperture 140 defining a liquid inlet extends through the upper surface 112. A plurality of arms 142 extend radially inwardly into the aperture 140. A liquid inlet valve member 150 includes a shaft portion 152 captured within the aperture 140. The inlet valve 150 is a one-way or non-return valve and includes an enlarged diameter sealing member 154 at a first, lower end of the shaft and an enlarged head portion 156 at a second, upper end of the shaft. In certain embodiments, the liquid inlet ball check valve may be replaced with the liquid inlet valve member configuration as described below by way of reference to the embodiment appearing in FIGS. 11-27.

In operation, a dispensing cycle includes a dispensing portion wherein air and liquid are simultaneously forced out of the chambers 125 and 135, respectively, and a fill portion, wherein a foamable liquid from the liquid container or reservoir such as flexible bag 300 (see FIG. 10) is drawn into the chamber 135 and ambient air is drawn into the chamber 125. During the initial, dispensing portion when there is increased pressure within the liquid chamber, the sealing member 154 bears against the upper surface 112 and provides a sealing interference between the inlet valve 150 and the aperture 140 to prevent liquid in the liquid chamber from exiting the chamber and passing back into the liquid container or reservoir 300 through the aperture 140. During the fill portion of a dispensing cycle, responsive to a decrease in pressure in the liquid chamber, the inlet valve 150 moves downward to allow liquid to pass from the bag or reservoir 300 into the liquid chamber by passing around the inlet valve 150 and through the aperture 140. The enlarged head 156 limits the extent of axial movement by the inlet valve 150 within the aperture 140. The inlet valve 150 may be formed of a flexible or resilient material, e.g., an elastomeric or other sufficiently flexible polymeric material. The enlarged head portion 156 may have a tapered or barbed exterior shape that facilitates passage of the enlarged head portion 156 through the aperture 140 during manufacture of the pump assembly while resisting removal of the valve 150 from the opening 140 during operation.

Upstanding features such as radial ribs 160 and/or and wall members 162 may be formed on the upper surface 112 to protect the valve 150 from interference with the liquid container, such as the flexible bag 300, as it collapses when liquid 304 in the reservoir is withdrawn. By holding the collapsing bag off the liquid inlet, the features 160, 162 allow for continued product evacuation as the bag volume decreases around the pump. The features 160, 162 also improve the structural rigidity of the upper surface 112.

A dual piston assembly 170 is received within the open end 118 of the dual cylinder 110. The dual piston assembly 170 includes an air piston member 172, a liquid piston assembly 174, and a liquid outlet valve 192.

The air piston member 172 includes an upper, open end 178 having a sealing ring 180 attached thereto. The sealing ring 180 is dimensioned to make sliding and sealing contact with the inner surface 116 of the outer wall 114. The liquid piston assembly 174 includes a piston ring 182 received within the liquid chamber 135 and is sized to slidingly and sealingly engage the inner surface 132 of the inner annular wall 130.

The piston ring 182 is mounted on the upper end 184 of the liquid piston assembly 174. The upper portion 184 of the piston assembly 174 defines a hollow shaft or conduit 186. The lower end 188 of the piston assembly 174 defines a valve seat 190 receiving a valve member 192. The valve seat 190 and the valve member 192 cooperate to define a one-way or nonreturn liquid outlet valve. Axial flow channels 191 are formed in the upper portion of the valve member 192 to provide fluid communication between the hollow shaft portion 186 and the valve seat 190.

Figure 3:
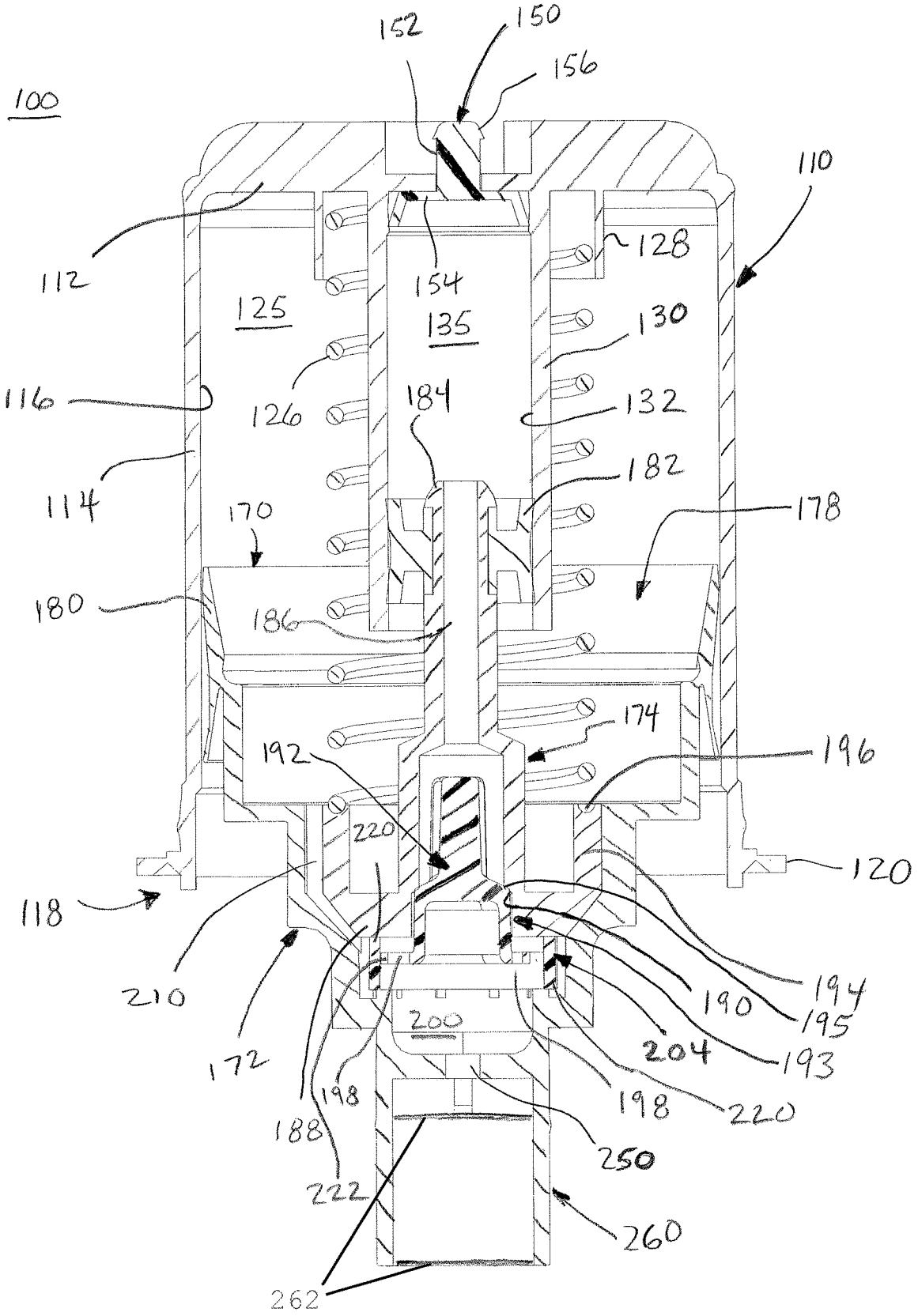
FIG. 3 is a side cross-sectional view taken along the lines 3-3 appearing in FIG. 2.
Figure 4:
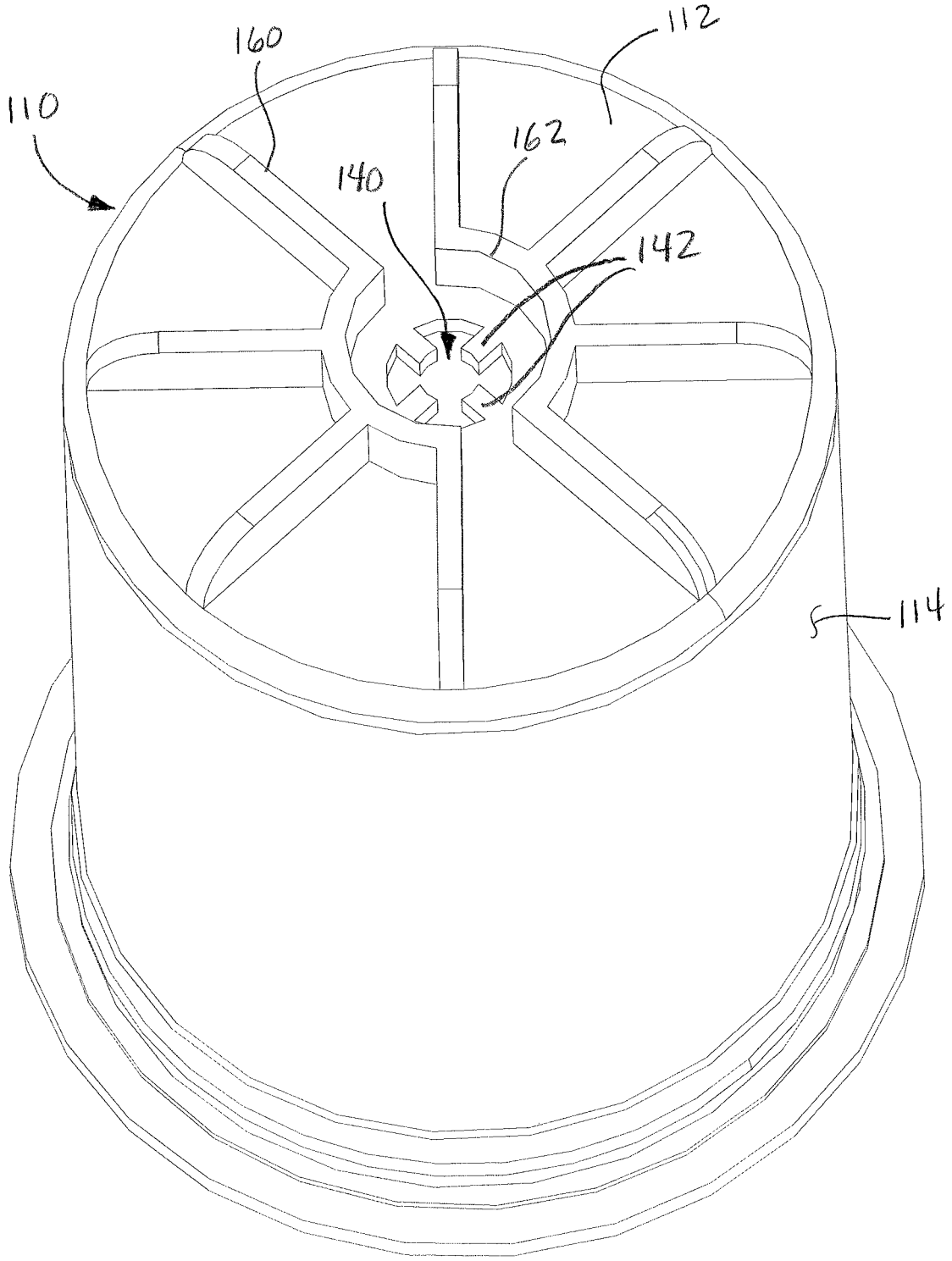
FIG. 4 is an isometric view of the dual cup portion, taken generally from above and from the side.

In the illustrated embodiment, as best seen in FIG. 3, the valve seat 190 is defined by the shoulder portion of a counterbore or countersink region 193 formed in the piston assembly 174. The shoulder portion 193 in the piston assembly 174 cooperates with an enlarged diameter portion 195 on the valve member 192 to define a normally sealed check valve. The liquid outlet valve 192 may be formed of a flexible or resilient material, e.g., an elastomeric or polymeric material. The lower end 188 of the piston assembly 174 also includes an upstanding annular wall 194 defining a spring seat 196 for receiving the lower end of the spring member 126.

During the dispensing portion of a dispensing cycle, when there is increased pressure within the liquid chamber, the flexible and resilient nature of the liquid outlet valve member 192 allows the member 192 to flex such that the portion 195 of the valve member 192 contacting the shoulder portion 193 of the valve seat moves away from the valve seat 190 to allow liquid in the chamber 135 to flow through the conduit 186, around the valve member 192, and through apertures 198 in the valve member 192 and into a mixing chamber 200 defined in the air piston member 172. During the fill portion of a dispensing cycle, responsive to reduction in pressure in the liquid chamber, the resilient nature of the outlet valve member 192 causes the valve member 192 to return to its original shape to provide a sealing engagement between the liquid outlet valve 192 and the valve seat 190.

In the preferred embodiments, the liquid outlet valve member 192 is resiliently biased toward a sealing engagement with the valve seat 190, thereby providing a preselected threshold or cracking pressure necessary to unseat the valve member 192 from the valve seat 190. Once the valve is open, the resilient property of the valve member 192 provides the valve member 192 with a closing force or pressure, which defines a threshold pressure below which the valve will move from the open position to the closed or seated position. In operation, once the pressure in the liquid chamber 135 falls below the threshold closing pressure, the valve member 192 returns to sealing engagement with the valve seat 194.

It has been found that it is possible for the dual cylinder assembly 110 and the dual piston assembly 170 to stick partway through a dispensing operation wherein the dual piston assembly 170 fails to return completely to the non-actuated or home position, e.g., due to stiction/friction between the assemblies 110, 170, due to the application of off-axial forces to the piston assembly 170, etc. In certain embodiments, the cracking pressure and/or closing pressure of the valve member 192 is selected such that the valve member will return to sealing engagement with the valve seat 190 to thereby prevent leaking through the liquid outlet valve once the pressure of the liquid in the liquid chamber 135 falls below the valve closing pressure, independently of the position of dual piston assembly 170 in relation to the cylinder assembly 110. That is, because the liquid outlet valve is biased toward the closed or sealed position with a closing pressure, the liquid outlet valve does not require a subsequent volume increase in the liquid chamber following a dispensing operation in order to close, but rather, only requires the outwardly directed flow pressure exerted by the collapsing liquid chamber volume to fall below the closing pressure threshold of the resiliently biased outlet valve.

In alternative embodiments, the resilient valve member 192 and seat 190 may be replaced with an alternative valve structure that is spring biased or otherwise resiliently biased into the closed or seated position and opens when a threshold pressure is created in the liquid chamber (due to collapsing volume of the liquid chamber) and closes when that pressure is removed (e.g., when the liquid chamber halts it volume reduction). For example, in certain embodiments, the illustrated liquid outlet valve can be replaced with a check valve comprising a spring and captured ball type check valve disposed within the flow passageway, wherein the spring urges the ball into sealing engagement with a valve seat as would be understood by persons skilled in the art. The spring constant of the spring may be selected to provide a desired closing pressure. As the liquid chamber is compressed, the liquid moves the ball out of the seated position against the urging of the spring, thereby compressing the spring and allowing the liquid to flow around the ball and into the mixing chamber. When the actuator is released, the spring will cause the ball to return to the seated position and close the liquid outlet valve once the volume in the liquid chamber has stabilized, even if the liquid piston does not return to its original home position.

Figure 5:
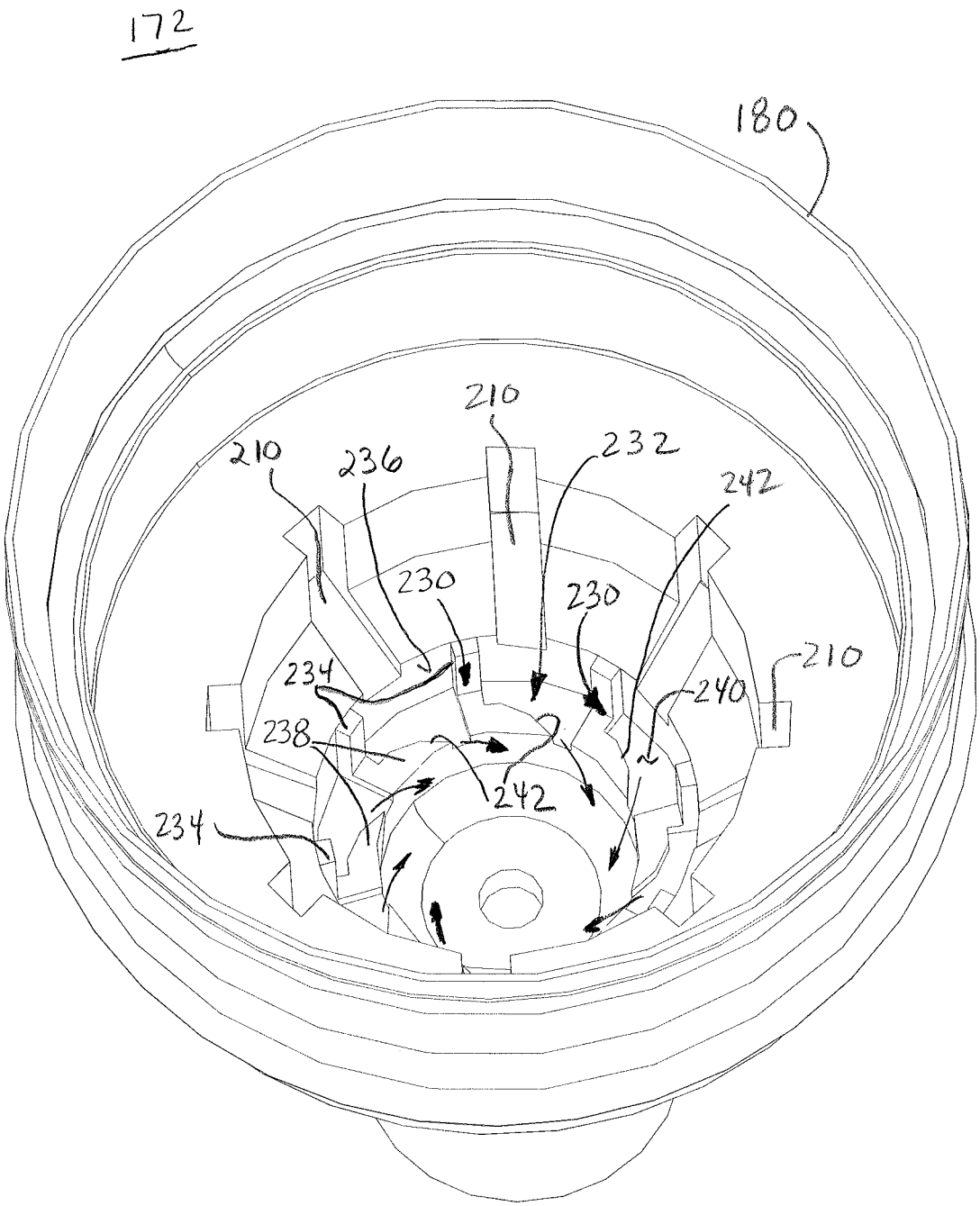
FIG. 5 is an isometric view of the dual piston, taken generally from above and from the side.
Figure 6:
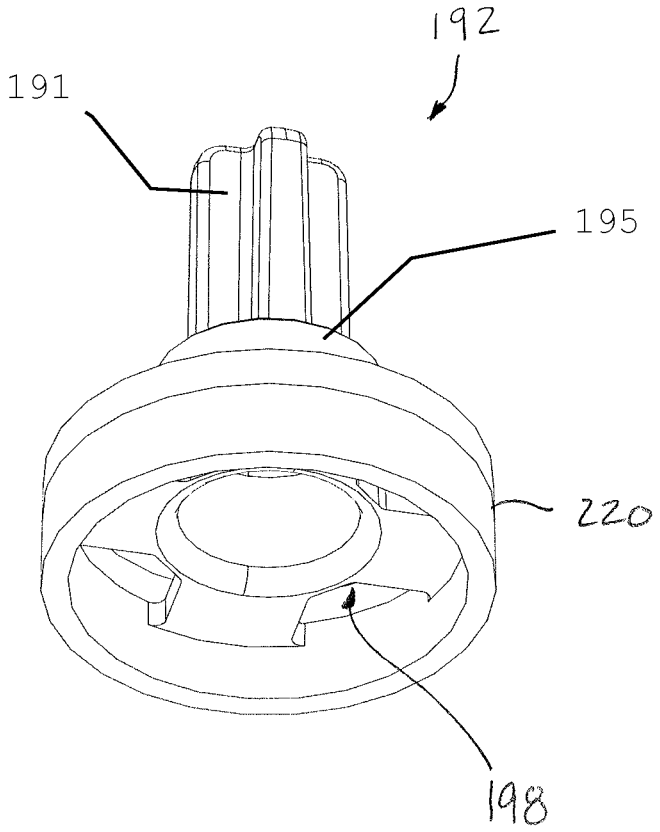
FIG. 6 is an enlarged isometric view of the liquid outlet valve.

During a dispensing cycle, the dispensing portion is initiated by upward movement of the air piston member 172 together with the liquid piston assembly 174, e.g., by manually moving the air piston member 172 and the liquid piston assembly 174 against the urging of the spring 126 using a dispensing lever 364 (see FIG. 10) on the dispenser 310. As best seen in FIG. 5, as the air piston member 172 moves upward, air in the chamber 125 is forced through channels 210 defined in the interior wall of the air piston member 172. A plurality of channels 210 are radially disposed about the center longitudinal axis of the pump 100. The channels 210 are formed adjacent the lower end 188 and upstanding annular wall 194 of the liquid piston assembly 174, which cooperate with the air piston member 172 to define a plurality of air passageways.

The valve member 192 includes a base or foot portion 204 having an annular sealing ring 220 peripherally bounding a flange portion 222 containing the perforations 198. The sealing ring 220 is seated on a plurality of turbulence producing members 230 formed within and circumferentially spaced within a counterbore 232 formed within the air piston member 172. The turbulence-producing members 230 are angularly disposed in between adjacent channels 210. Each of the turbulence producing members 230 includes an internal rib or spline 234 formed on a generally vertical surface 236 of the counterbore 232 and a vane 238 formed on a generally horizontal surface 240 of the counterbore 232.

The upper edge of the sealing ring 220 provides a sealing interference with the lower end 188 of the liquid piston assembly 174 to direct the air from the channels 210 toward the vanes 238. Each of the vanes 238 includes an angled surface 242, which imparts rotational movement to the airflow entering the mixing chamber 200, thereby imparting a vortex flow to the air conducted to the mixing chamber. The vortex airflow in the mixing chamber 200 increases turbulent mixing of the air and liquid in the mixing chamber 200.

The foam in the mixing chamber 200 exits the mixing chamber through an aperture or constriction 250 in the base of the mixing chamber and passes to a foam outlet passageway 260. One or more nets or screens 262 (two in the preferred embodiment) may be provided in the passageway 260 to create a generally uniform air bubble size in the foam.

Figure 7:
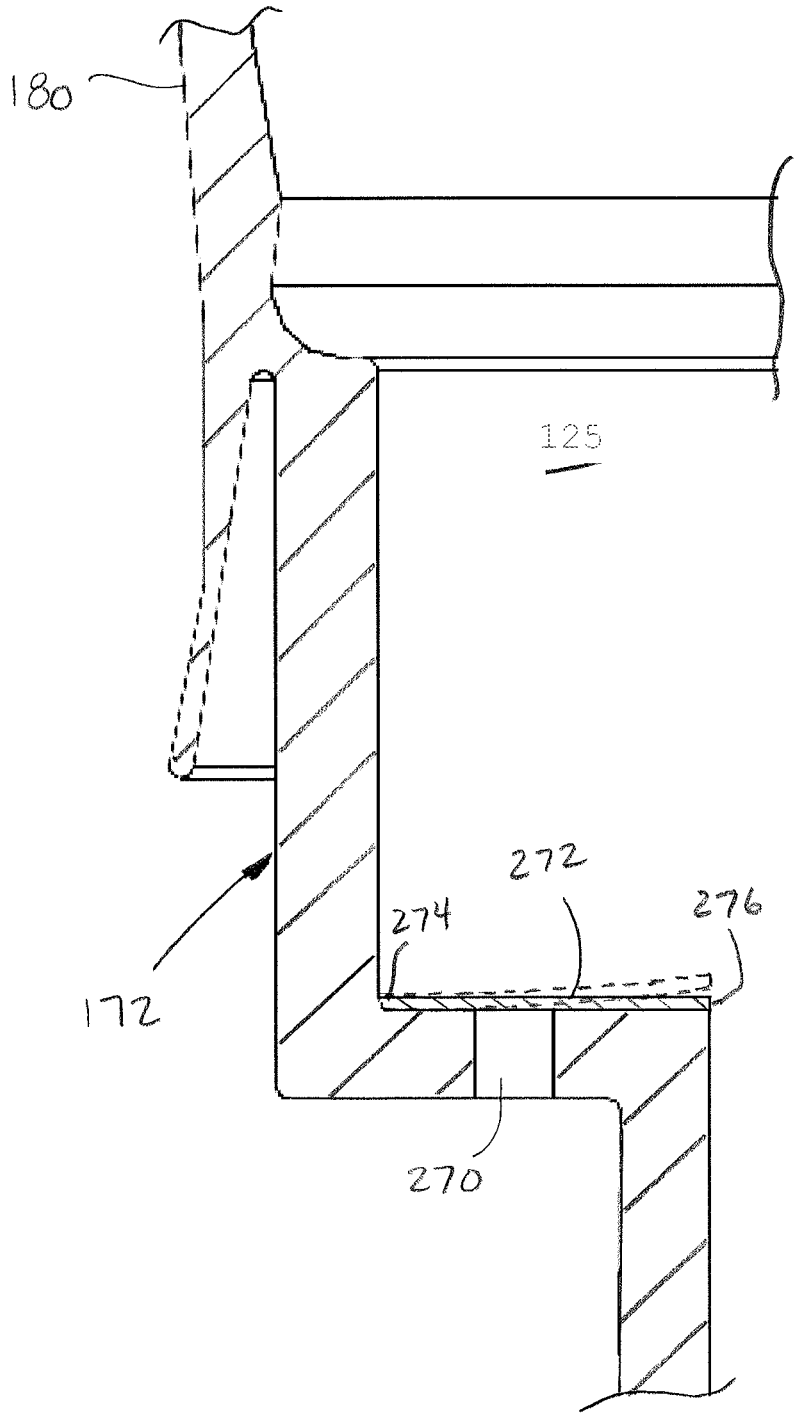
FIG. 7 is fragmentary side cross-sectional view of the air piston member illustrating an exemplary alternative air inlet.

During the fill portion of the dispensing cycle, as the dual piston assembly 170 moves downward at the urging of the spring member 126, liquid enters the chamber 135 via the liquid inlet valve member 150 as detailed above and ambient air enters the air chamber 125 through the mixing chamber 200. Air entering the air chamber 125 passes between the turbulence-producing members 230 and through the channels 210. In alternative embodiments, a separate, one way or return air valve may be provided. An exemplary alternative air piston member having a one-way valve which permits air to enter the chamber 125 during the fill portion of the dispensing cycle is illustrated FIG. 7. In the illustrated alternative embodiment of FIG. 7, one or more air inlets 270 are provided in the air piston member 172. A valve flap 272 covers the opening 270 on the interior surface of the air piston member 172. The valve flap 272 is attached to the interior surface at a proximal end 274 and has a free distal end 276. During the dispensing portion of the dispensing cycle, the increased air pressure in the chamber 125 seals the flap 272 against the opening, thereby closing the air inlet valve. During the fill portion of the dispensing cycle, the distal end 276 of the flap 272 is free to move away from the opening 270 to permit ambient air to enter the chamber 125 through the opening 270.

In certain alternative embodiments (not shown), the air outlet passageways 210 are selectively occluded to air ingress by a one way elastomeric or polymeric valve/flap placed in the air passageway 210, the counterbore 232, or projecting off the liquid outlet valve 192. Such embodiments may be employed in conjunction with separate, selectively occluded air inlets, such as the occluded inlets 270 as described above and illustrated in FIG. 7. The combined effect of the occluded inlets 270 and the occluded outlets 210 being a separate path for air input to and air output from the air chamber 125.

Figure 8:
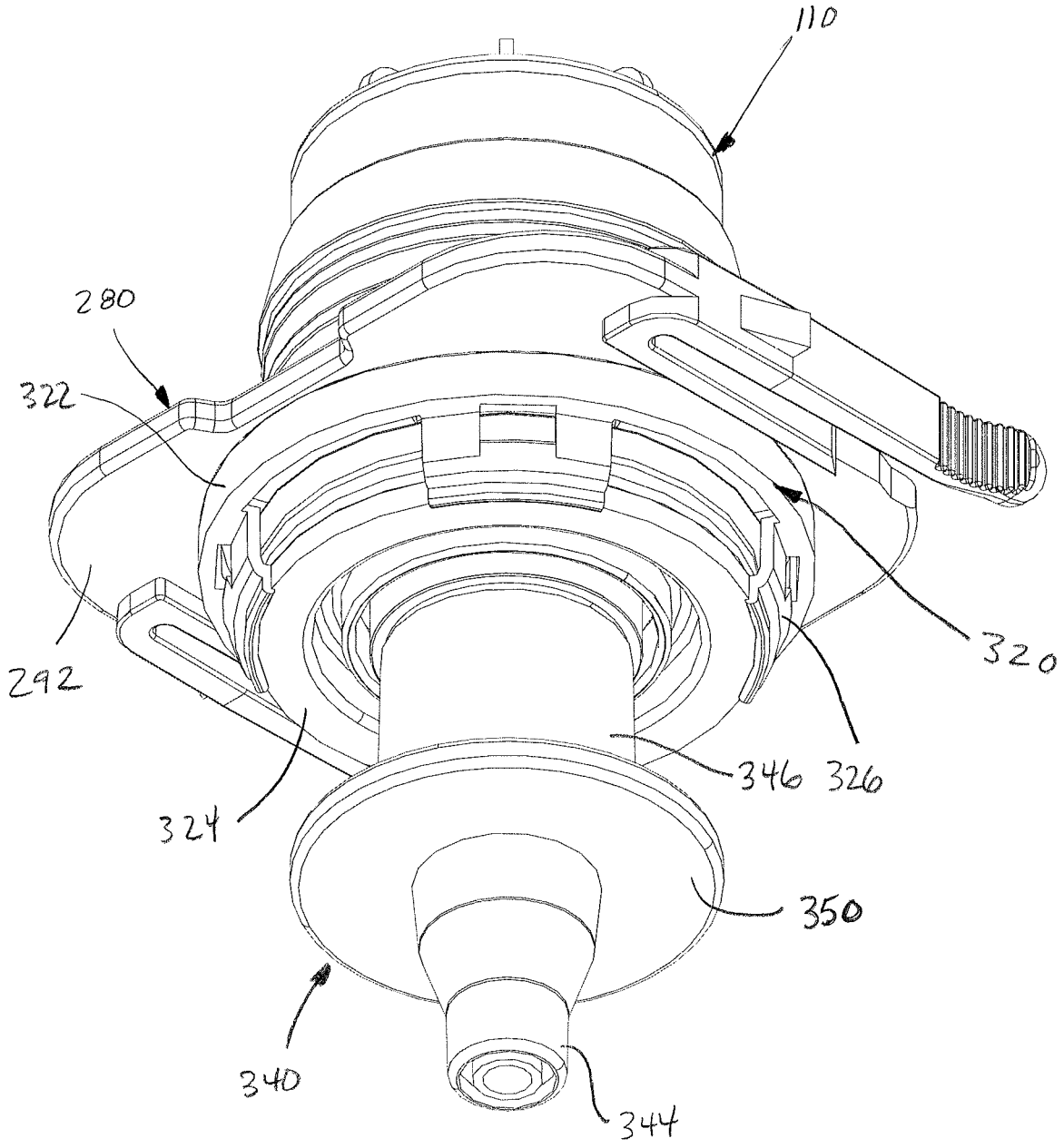
FIG. 8 is an isometric view taken generally from below and from the side illustrating the foam pump embodiment of FIG. 1 having an adapter ring and adapter for mounting the foam pump within a wall-mounted dispenser.
Figure 9:
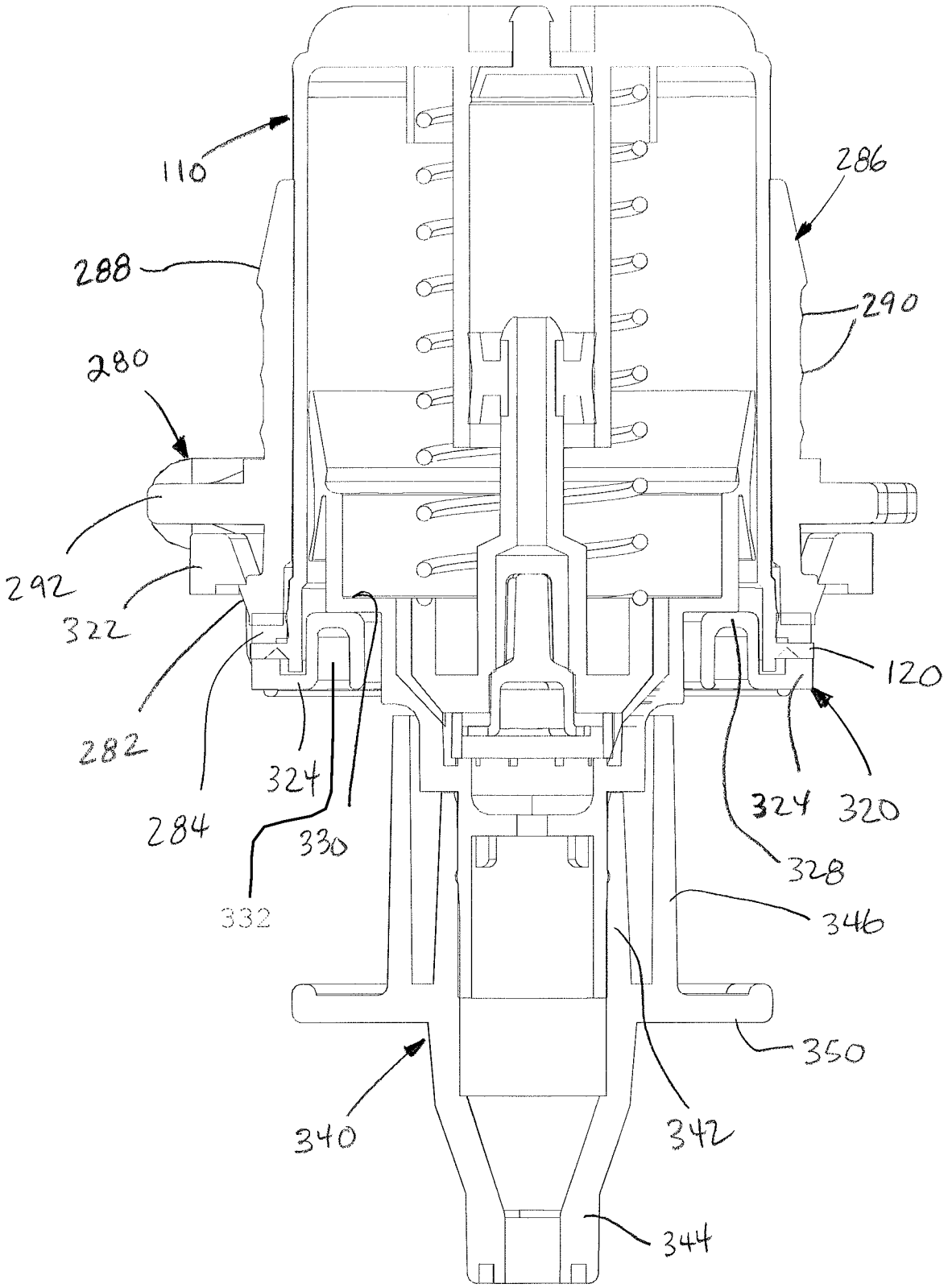
FIG. 9 is a side cross-sectional view of the foam pump with adapter ring and adapter.

Referring now to FIGS. 8-10, an adapter sleeve 280 defines a central opening coaxially receiving the dual cylinder 110. The adapter sleeve 280 includes a lower end 282 engaging a sealing ring 284 such as an O-ring or gasket which in turn engages the flange 120 on the dual cylinder 110. The adapter sleeve 280 includes an upper end 286 configured to be received within a fitment 302 of a flexible bag 300 defining a reservoir containing a foamable liquid 304 which may be of the type suitable for use in a so-called bag-in-box type dispenser. The upper end 286 may include a barb 288 and one or more pressure ribs 290 for securing the upper end 286 within the fitment and for providing a fluid tight seal therebetween. The adapter sleeve 280 further includes an intermediate portion 292 intermediate the upper and lower ends and configured to engage a complementary receptacle or nest 312 within the dispenser 310. The dispenser 310 and adapter sleeve 280 may be as shown and described in U.S. Pat. No. 8,336,740, incorporated herein by reference in its entirety.

An adapter ring 320 encircles the lower end 282 of the adapter sleeve 280 and the flange 120 of the dual cylinder 110. The adapter ring 320 includes an upper ring 322 engaging the lower end 282 and a lower ring 324 engaging the flange 120. A plurality of connecting arms 326 attaches the upper ring 322 to the lower ring 324. The lower ring 324 also includes an annular stop 328 which extends radially inward of the open end 118 of the dual cylinder 110 which limits the downward extent of axial movement of the dual piston assembly 170 relative to the dual cylinder 110 and prevents the dual piston assembly 170 from disengaging from the dual cylinder 110. The adapter ring 320 may be as shown and described in the aforementioned U.S. Pat. No. 8,336,740.

In the illustrated embodiment, the air piston member 172 includes a counter bore 330 which defines a shoulder engaging the stop 328. The upper and lower rings 322, 324 are preferably spaced apart in the axial direction by a distance which provides a clamping force on the lower end 282, the sealing ring 284 and the flange 120 to provide secure retention of the foam pump assembly 100 and to prevent leakage of any liquid that may pass between the upper end 286 and the outer wall 114 of the dual cylinder 110. The stop 328 may be configured with an annular groove 332 defining a spring seat for receiving the upper end of an auxiliary spring member 334.

A nozzle 340 includes an inner cylindrical wall 342 receiving the foam passageway 260, which may be secured therein, e.g., via a press fit or snap fit connection. The nozzle 340 also includes a dispensing outlet portion 344 downstream of the inner cylindrical wall 342.

A flange 350 extends radially outwardly at a position on the nozzle 340 intermediate the inner cylindrical wall 342 and the dispensing outlet portion 344. An outer cylindrical wall 346 is coaxial with respect to the inner cylindrical wall 342 and extends upwardly from the flange 350. Optionally, a spring member 334 may be provided around the outer wall 344, with an upper end received within the spring seat 332 and a lower end bearing against the flange 350 to provide an additional downward biasing force to urge the dual piston assembly 170 to the home position. The spring member 334 may be provided in addition to the spring 126 or as an alternative thereto.

The foam pump assembly 100 may advantageously be used in a dispenser 310 of the type appearing in FIG. 10. The dispenser includes a housing 360 which may include a pivoting front cover 362 for providing easy access to the interior of the dispenser to remove spent pump/bag assemblies and install new pump/bag assemblies. The dispenser 310 may be as shown and described in the aforementioned U.S. Pat. No. 8,336,740.

The dispenser includes a lever 364 pivotally mounted within the dispenser at a pivot point 366. The lever 364 includes a push bar 368, which is manually actuated by the user during operation and a lever arm 370 engaging the lower surface of the flange 350. Inward pressing of the push bar 368 by the user causes upward movement of the dual cylinder assembly 170 corresponding to the dispensing portion of the dispensing cycle. Upon release of the push bar 368, the spring member 126 and/or spring member 334 urge the dual cylinder assembly 170 downward back to the home position, corresponding to the fill portion of the dispensing cycle, wherein air and liquid are drawn into their respective chambers to await the next dispensing operation. A latch 372 on the pivoting cover 362 releasably engages a catch 374 on the housing 360 to secure the pivoting cover in the closed position.

Referring now to FIGS. 11-27 there is shown a second exemplary embodiment foam pump assembly 1100 with a modular air/liquid cylinder assembly. Instead of molding the liquid cup/chamber into the larger air cup as one integrated piece, the liquid cup and air cup are separately molded components, wherein the air cup is held within the surrounding air cup with a friction fit or snap fit, or other fastener type. In certain embodiments, a plurality of differently-sized liquid cup modules are provided which can be interchangeably secured within a common air cup design to provide a desire or preselected foam dose size.

One advantage of employing a modular air/liquid cylinder assembly with separately formed air and liquid cup components is that it allows a manufacturer to produce foam engines with different or custom output weights or doses with minimal tooling investment per new output size. In certain embodiments, the only components that change are the relatively small liquid cup and liquid piston, thereby allowing custom tailored "shot sizes" of the product to be dispensed without having to tool the entire air cup piece for each new output size. Since these pieces are relatively small, stocking custom liquid chambers/pistons also conserves warehouse, storing, and shipping space as compared to completely customer-specific or product-integrated air/liquid cup parts.

The modular air/liquid cylinder assembly disclosed herein advantageously allows the product shot size to be tailored to certain applications, or in accordance with the properties of particular liquid products/formulations to be dispensed. For example, for school applications, small children generally have small hands and thus require less soap (i.e., a smaller dose) to satisfy efficacy standards. As such, a smaller dose (e.g., 0.5 ml) may be appropriate for primary school applications. By providing a smaller liquid cup which holds a volume of foamable liquid that targets this output dose conserves soap and, thus, school budgets, while still delivering effective doses for the target population.

A typical output for a general purpose foaming hand soap is 0.70 ml, which represents approximately a 10:1 air to liquid ratio. This produces a nice and airy foam quality, while also providing enough soap (i.e., the liquid component of the foam output) for average hand cleaning needs. However, some users may prefer a higher or lower ratio of air to liquid to satisfy either efficacy or foam quality concerns. A higher ratio of air to liquid generally produces a lighter foam, while a lower ratio of air to liquid generally produces a "wetter" foam and a generally more effective dose.

For certain applications, such as the use of hand sanitizers in healthcare and food packaging environments, certain users may require higher doses (i.e., heavier output) to increase the efficacy of each hand sanitizing operation (e.g., each single dispenser actuation). For instance, certain hand sanitizer formulations have been demonstrated to reach satisfactory sanitizing rates (e.g., a 3 log or one thousand fold reduction of microorganisms) at a single dose of 1.1 to 1.2 ml. In some instances, hand sanitizer output levels of up to 1.5 ml or higher may be warranted or desired. Thus, the present development is advantageous to increase the foam dosage size for use with hand sanitizer formulations that may not achieve a specified germ reduction (e.g., a 3 log reduction) at the standard dosing levels typical of hand soaps (e.g., 0.70 ml).

In certain embodiments, a plurality of modular, interchangeable liquid cups are contemplated to provide liquid product outputs ranging from about 0.3 ml to about 2.0 ml. In certain embodiments, the liquid product outputs range from about 0.4 ml to about 1.5 ml. In certain embodiments, the liquid product outputs range from about 0.70 ml to about 1.2 ml. In this manner, liquid cups configured for any custom output size can be provided with limited tooling investment.

Figure 11:
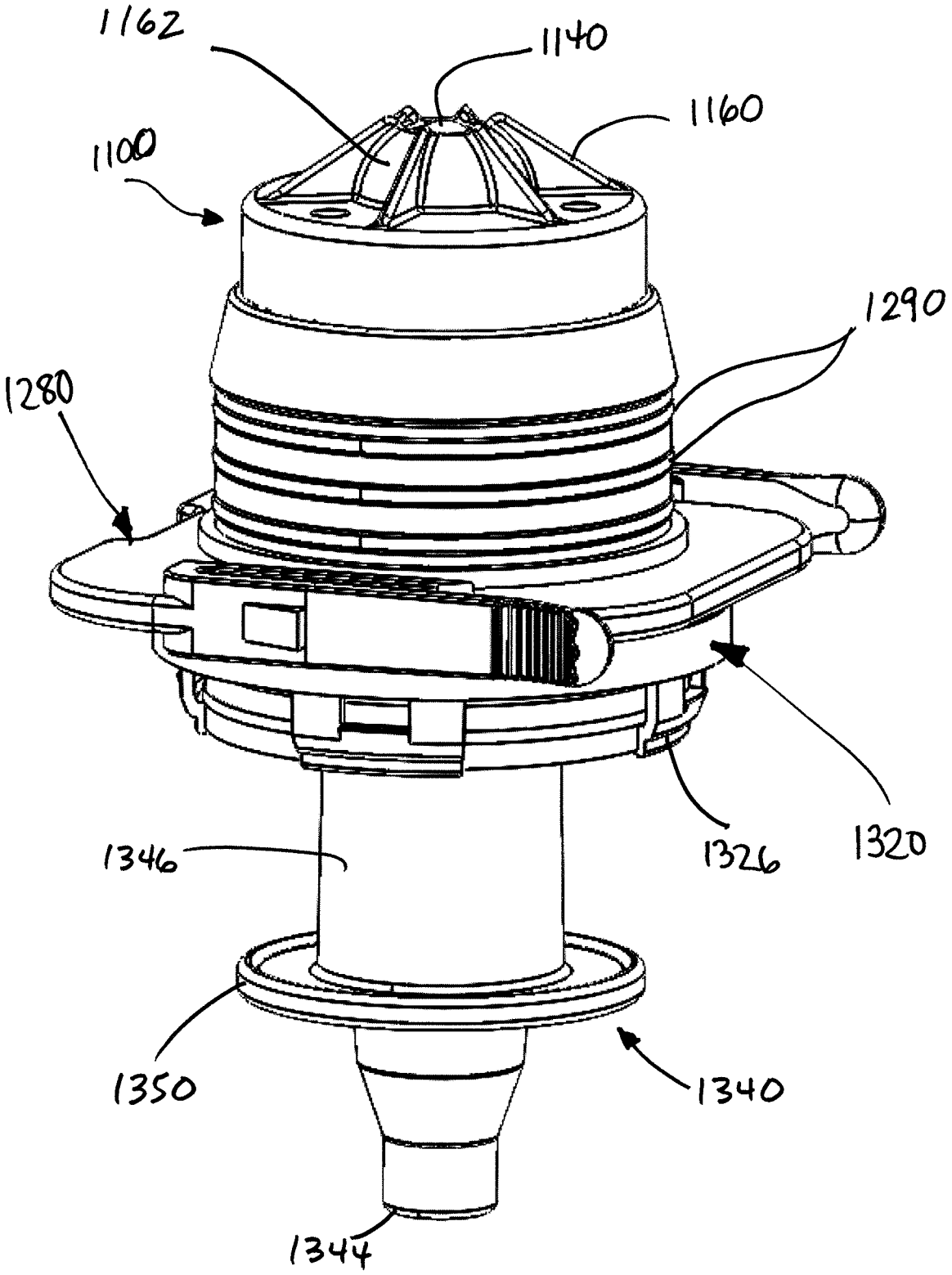
FIG. 11 is an isometric view of a foam pump in accordance with a second exemplary embodiment of the invention, taken generally from below and from the side, with the air and liquid dual piston assembly in the lower position.
Figure 12:
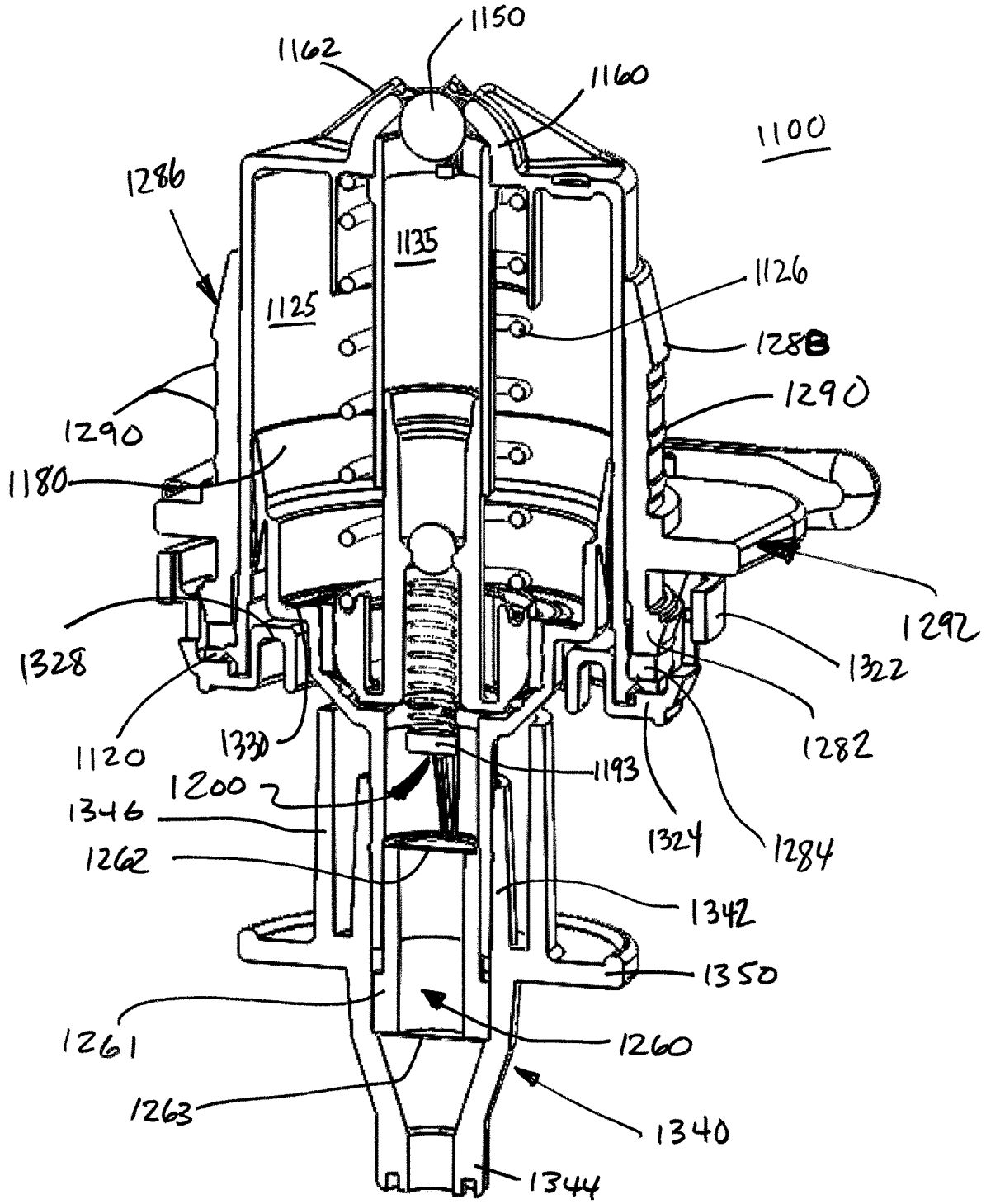
FIG. 12 is a cross-sectional view of the embodiment appearing in FIG. 11, taken generally from the side.
Figure 13:
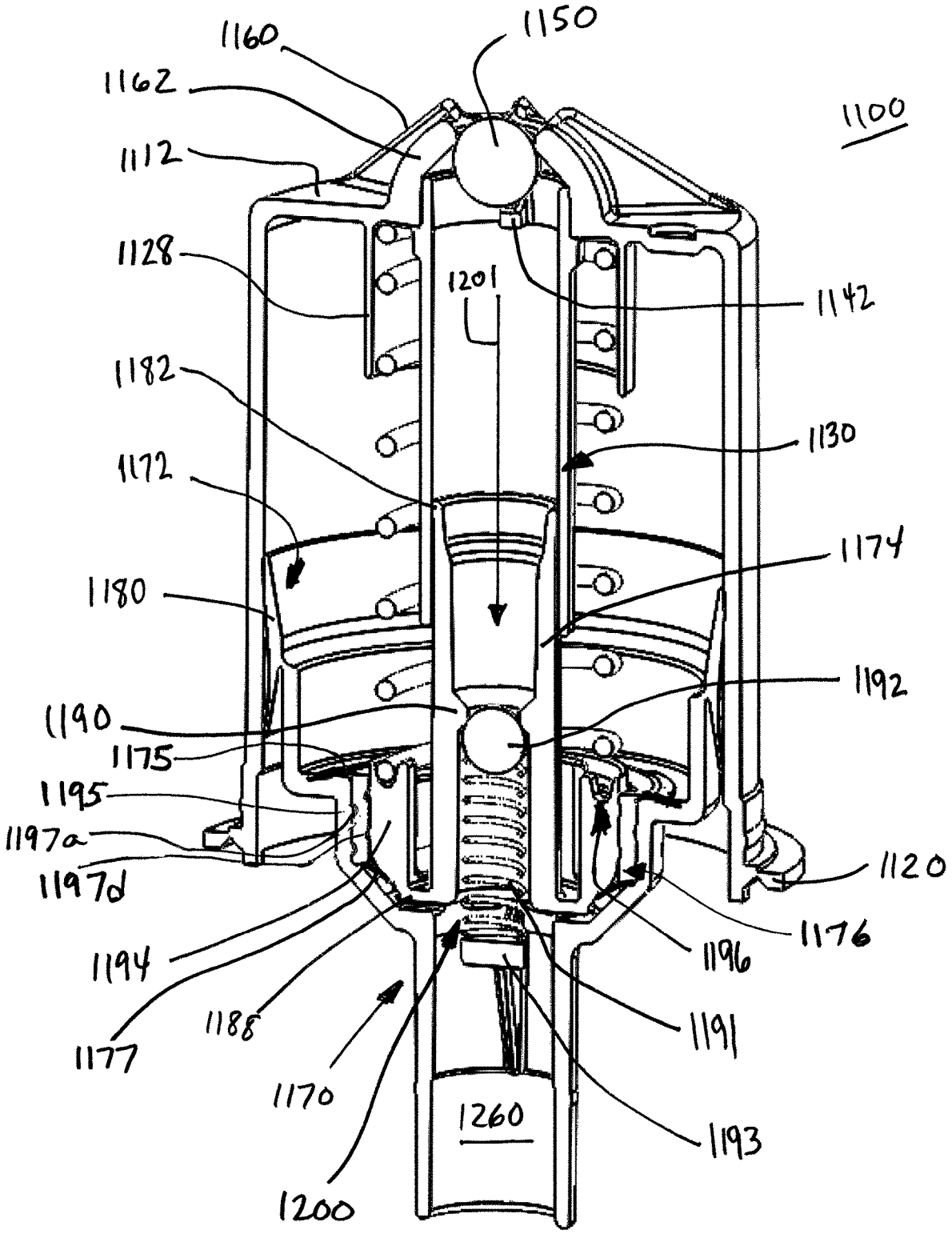
FIG. 13 is a cross-sectional view similar to the view appearing in FIG. 12, with the adapter ring and adapter sleeve removed.

As used herein, unless specifically stated otherwise, the terms "top," "bottom," "upper," "lower," and other such terms which are dependent on orientation are intended to refer to the orientation of the pump 1100 as shown in FIG. 11. FIGS. 11-21, 26, and 27 generally depict the foam pump in an orientation wherein the liquid inlet is at located the top and the liquid outlet is located at the bottom. It will be recognized, however, that the presently disclosed pump could also be adapted for use in other orientations. For example, the foam pump assembly 1100 could be used in applications wherein it is mounted in the opposite orientation, e.g., in the neck of a rigid dispensing container, such as a counter top or bottle type dispenser, e.g., by employing a dip tube to communicate with the liquid located at the bottom of the container. Likewise, the foam pump assembly herein could be used in a dispenser application wherein the flow axis/direction of piston movement is generally horizontal.

Figure 27:
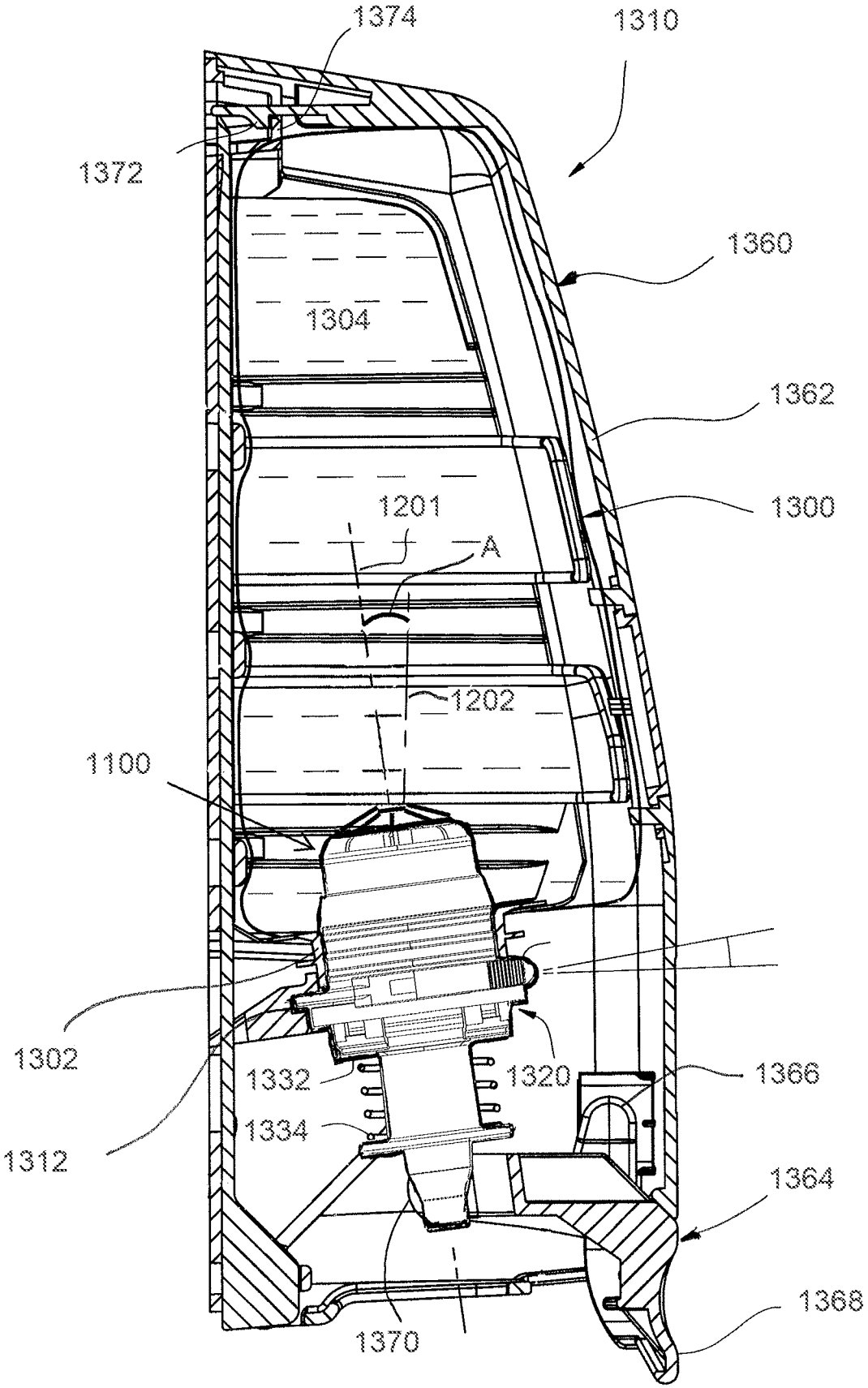
FIG. 27 is a side cross-sectional view showing the foam pump appearing in FIG. 11 within an exemplary dispenser.

In the inverted operational orientation depicted in FIG. 11, the dispensed liquid flows along a generally vertical flow axis 1201 (see FIGS. 13, 27) such that liquid pump outlet is at a lower vertical position than the liquid pump inlet and a liquid chamber 1135 containing the charge of liquid to be dispensed in a subsequent dispensing operation. The term "generally vertical" or "substantially vertical" is not intended preclude deviations of the flow axis from vertical. For example, the pump 1100 may be disposed in a dispenser 1310 (see FIG. 27) such that the longitudinal axis 1201 of the pump 1100 is displaced from a vertical axis 1202 of the dispenser 1310 by an angle A (see FIG. 27). For example, it has been found to be advantageous to configure the dispenser 1310 to receive the pump at an angle as seen in FIG. 27, which provides gravitational assistance when installing a pump/bag assembly into the dispenser to ensure that it is properly seated within the dispenser.

The liquids to be dispensed are preferably liquid hygiene products such as hand soaps, facial soaps, shampoos, body soaps, hand sanitizers including waterless hand sanitizers, water-based hand sanitizers, and the like. It will be recognized, however, that other foamable liquids having desirable characteristics when dispensed as a foam are also contemplated, such as hair mousses and foamable hair coloring formulations or compositions, shaving creams, lotions, and the like.

The pump assembly includes a dual air/liquid cylinder assembly 1110, which includes a generally inverted cup-shaped air cylinder 1111. The air cylinder 1111 includes an upper surface 1112 and an annular outer wall 1114 extending downward therefrom. The annular outer wall has an inward facing surface 1116. The upper surface 1112 and the annular outer wall 1114 cooperate to define an air chamber or air cylinder 1125. The air cylinder 1111 has a lower open end 1118 opposite the upper surface 1112. An external flange or ridge 1120 is disposed at or near the open end 1118.

The dual cylinder assembly 1110 has a two-piece construction, comprising a separately formed liquid cup 1130 having an upper, proximal end 1131 received within a complementary receptacle 1133 formed in the upper surface 1112 of the air cup 1111. The upper, proximal end 1131 is configured to be secured within the complementary receptacle 1133 via a friction fit, snap fit, press fit, or the like. Although the fastener element for securing the liquid cup 1130 to the air cup 1111 in the illustrated preferred embodiment is a complementary receptacle configured for a friction fit, snap fit, or press fit with the proximal end of the liquid cup, it will be recognized that other fastener types may be employed, including a helical thread on the liquid cup distal end 1131 and a complementary helical thread within the receptacle 1133, an adhesive fastener securing the proximal end 1131 within the receptacle 1133. In alternative embodiments, the liquid cup 1130 and air cup 1111 may be secured with threaded fasteners, adhesives, clips, clamps, dogs, pawls, or other mechanical fastener type.

Figure 14:
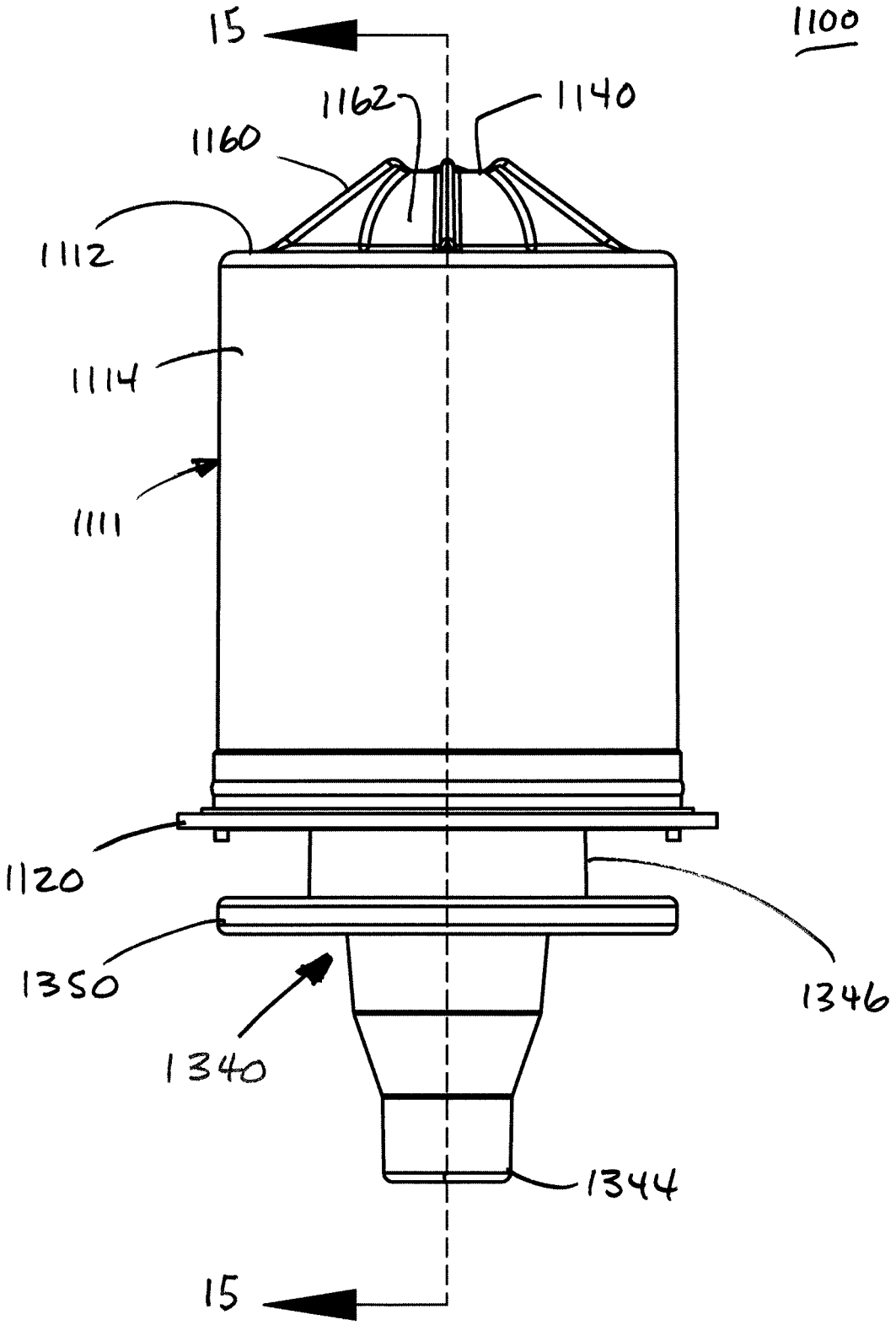
FIG. 14 is an elevational view of a modular system embodiment configured with a first (e.g., smaller) volume liquid dispensing cup, with the air and liquid dual piston assembly in the upper position.
Figure 15:
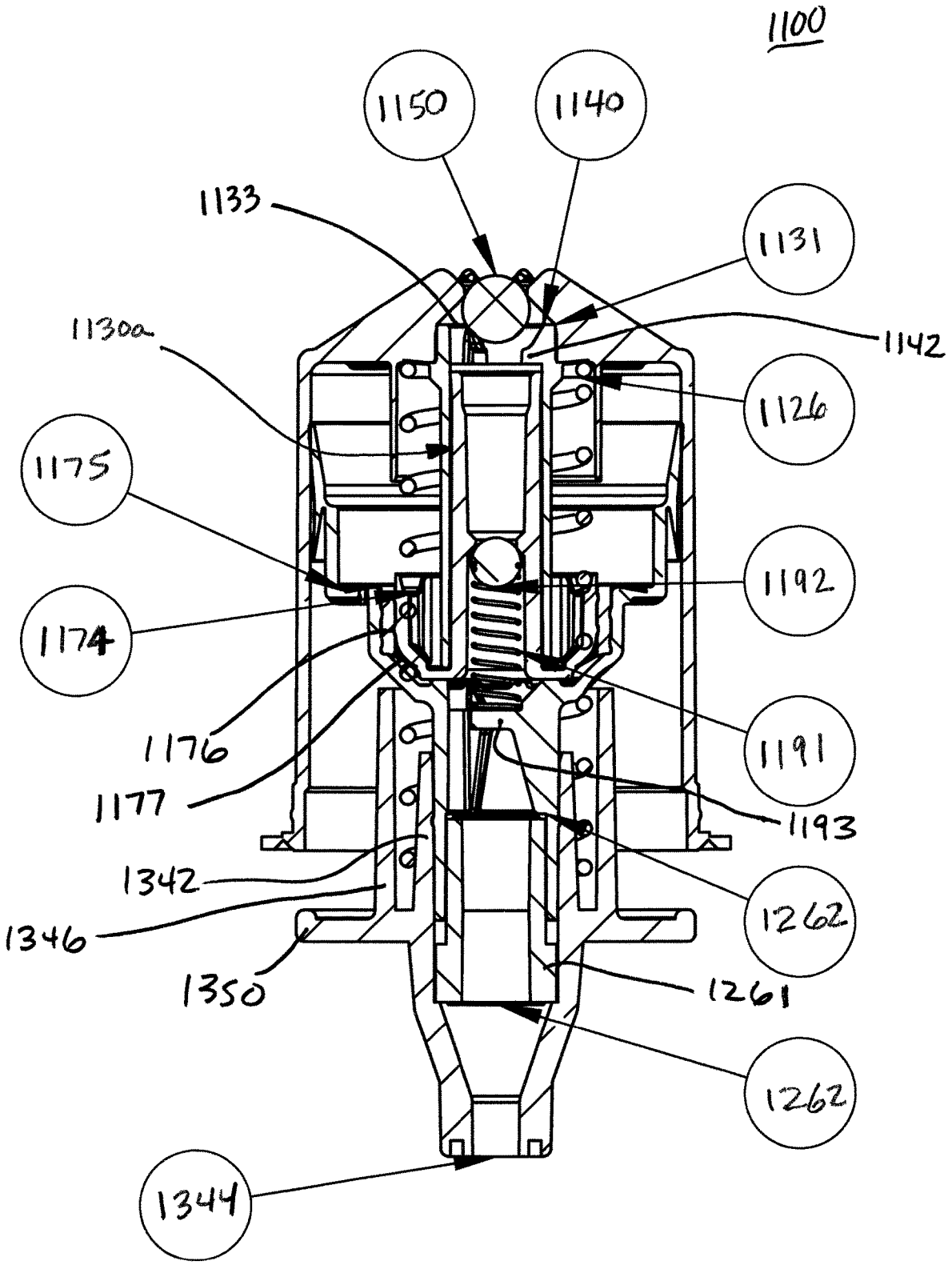
FIG. 15 is a side cross-sectional view taken along the lines 15-15 appearing in FIG. 14.
Figure 16:
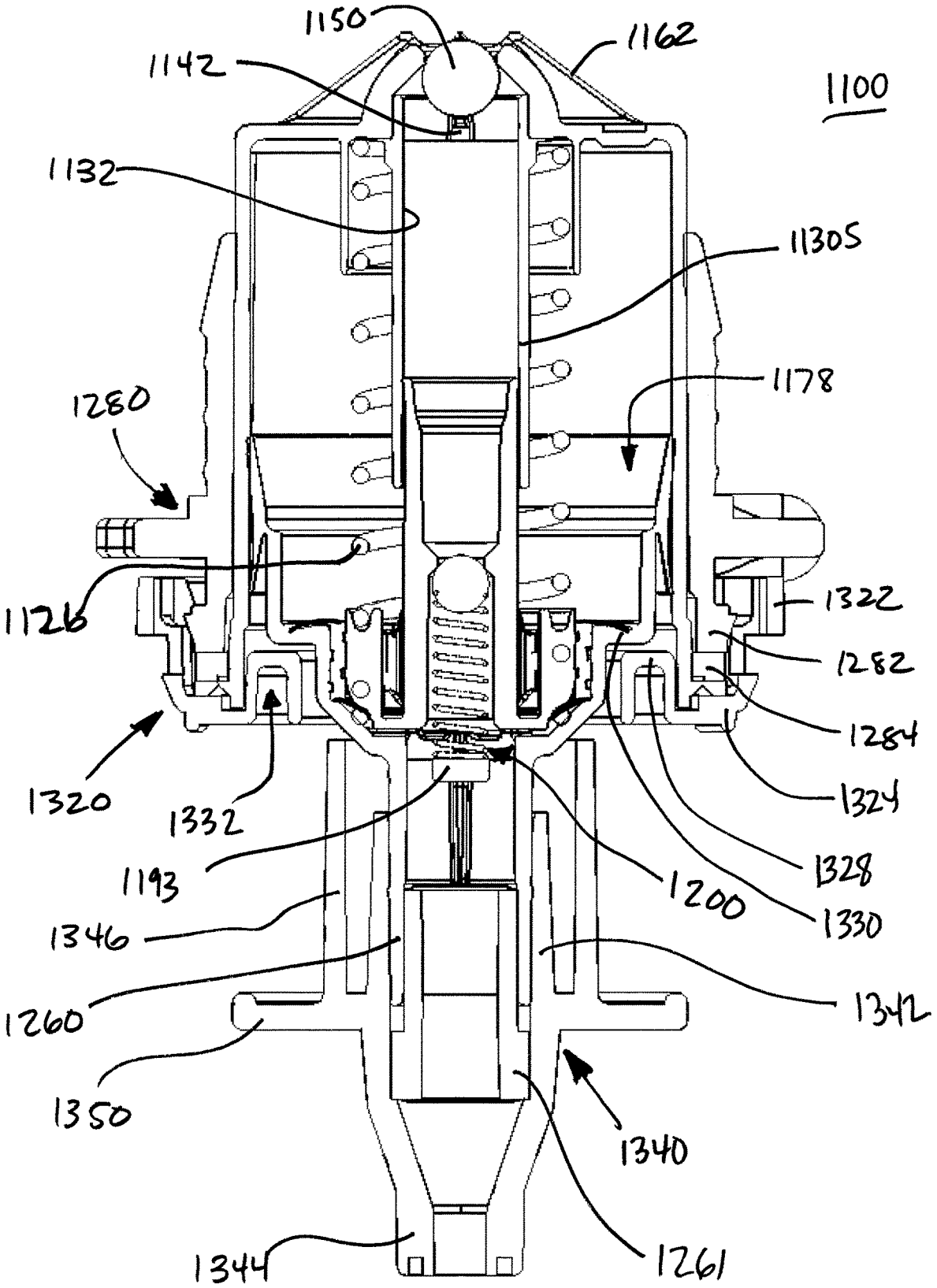
FIG. 16 is a side cross-sectional view of the embodiment appearing in FIG. 11, with the air and liquid dual piston assembly in the lower position.
Figure 17:
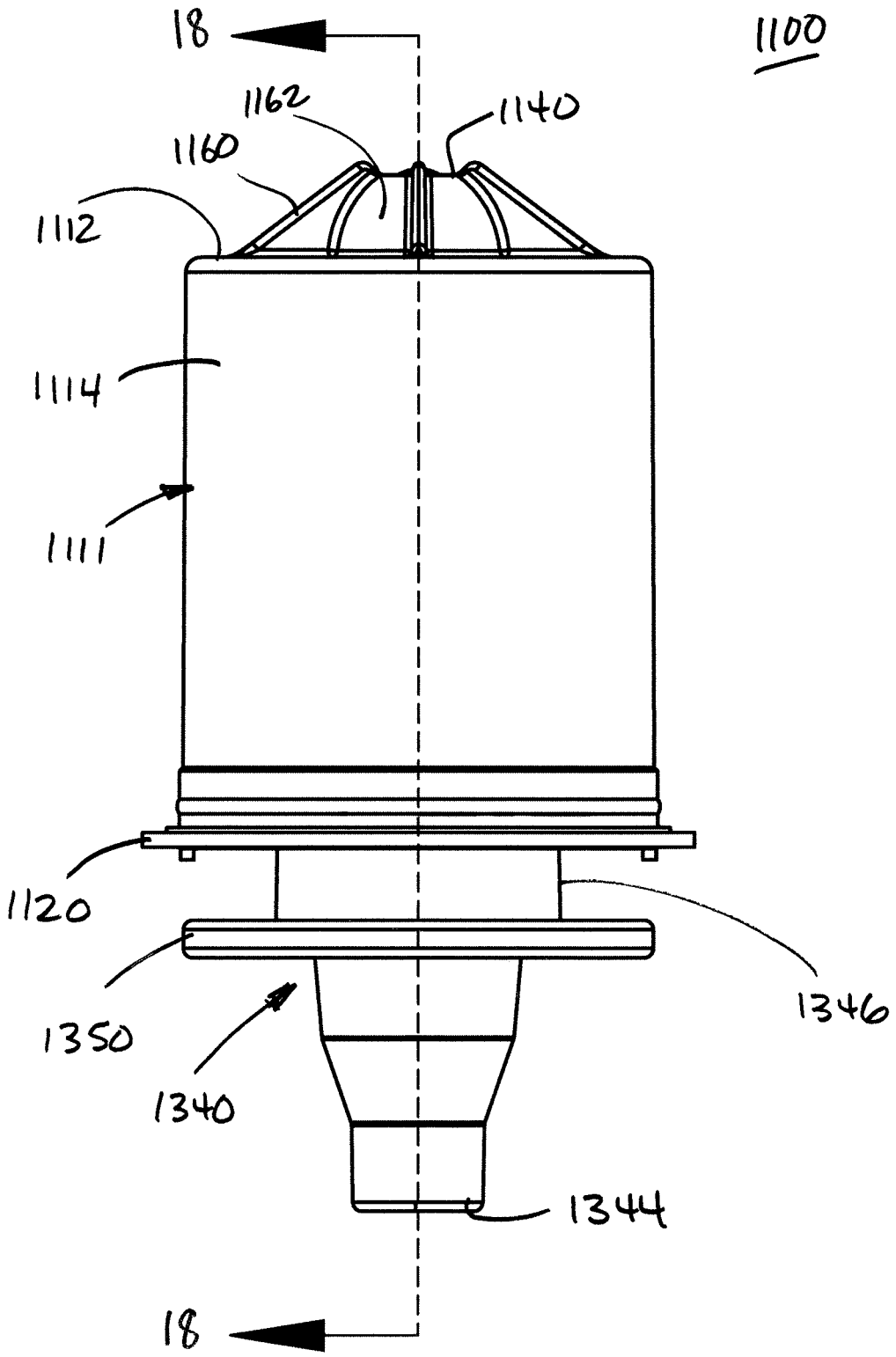
FIG. 17 is an elevational view of a modular system embodiment configured with a second (e.g., larger) volume liquid dispensing cup, with the air and liquid dual piston assembly in the upper position.
Figure 18:
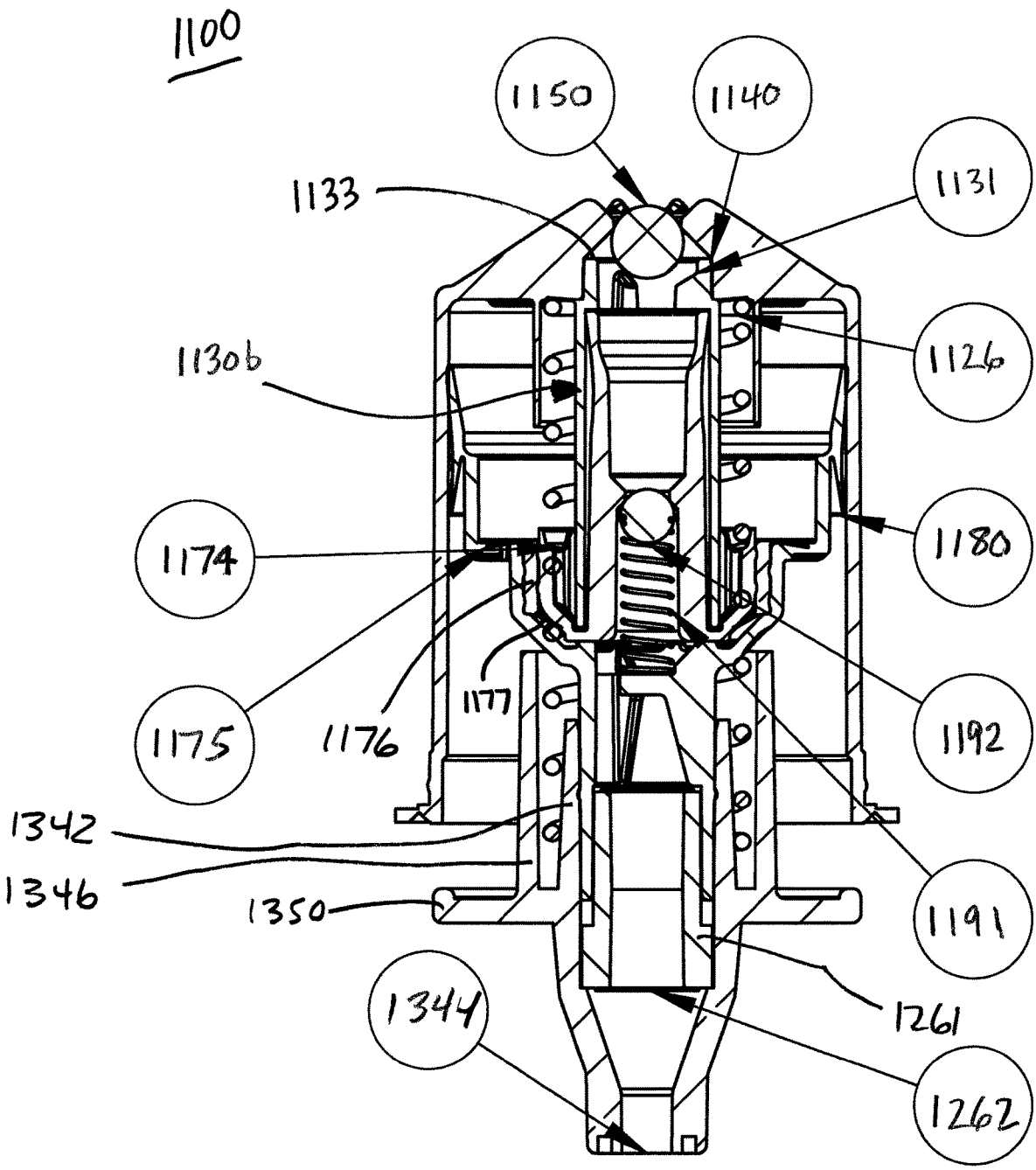
FIG. 18 is a side cross-sectional view taken along the lines 18-18 appearing in FIG. 17.
Figure 19:
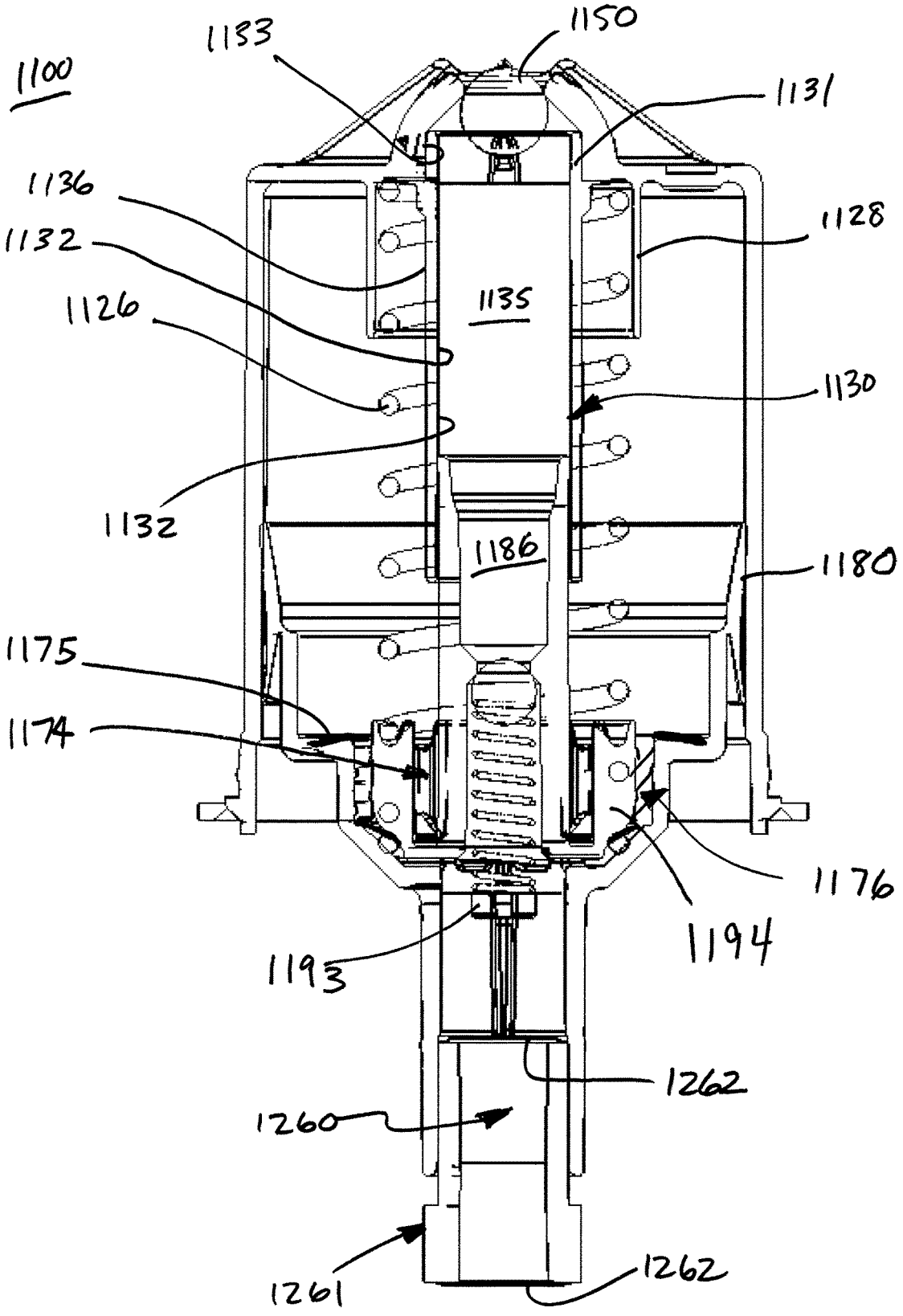
FIG. 19 is a side cross-sectional view of the embodiment appearing in FIG. 13, showing the mesh/net/screen holder in place downstream of the mixing chamber, and with the air and liquid dual piston assembly in the lower position.
Figure 20:
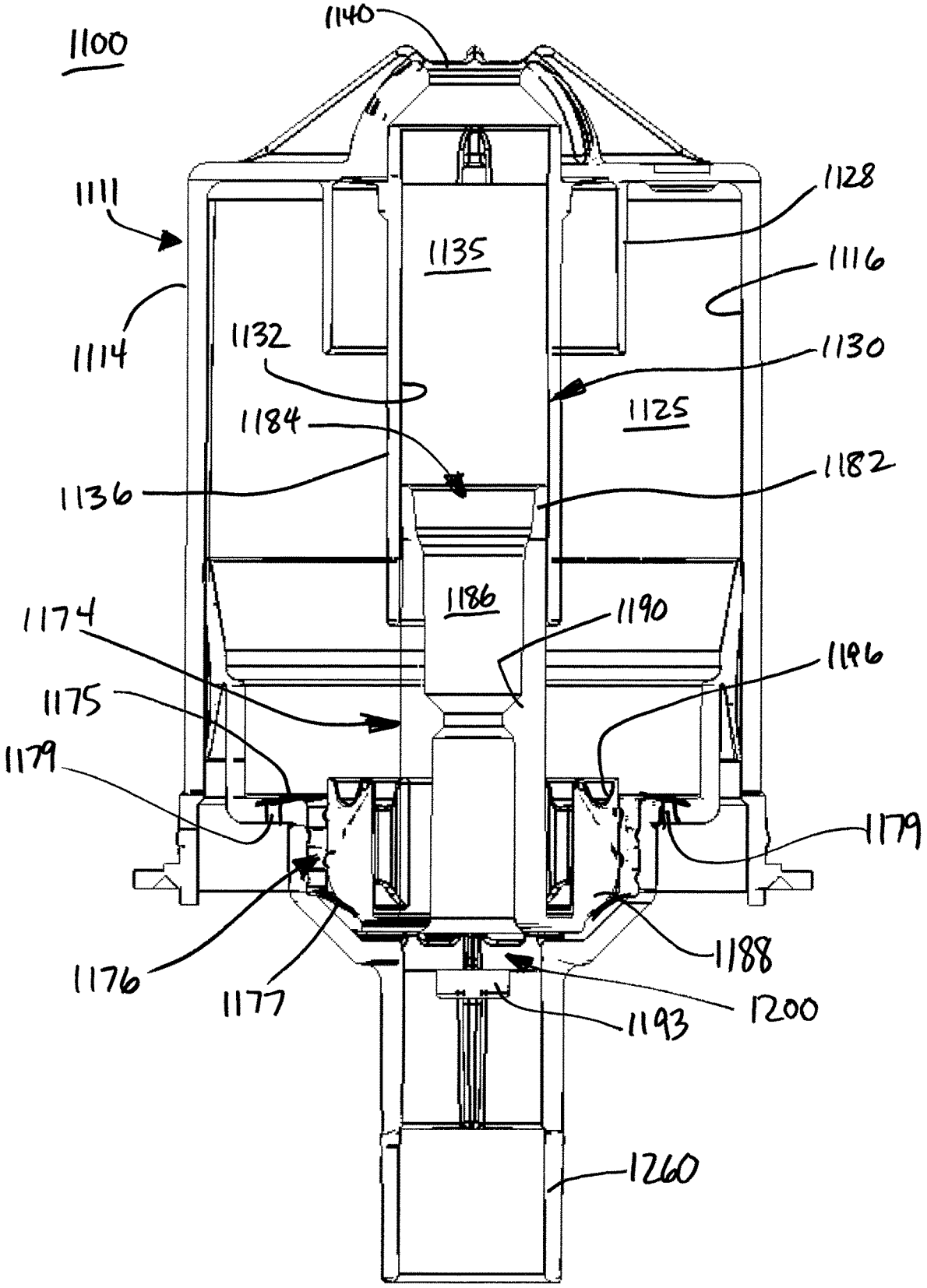
FIG. 20 is a side cross-sectional view similar to the view seen in FIG. 19, but with the liquid inlet and outlet check balls, springs, and net holder removed
Figure 21:
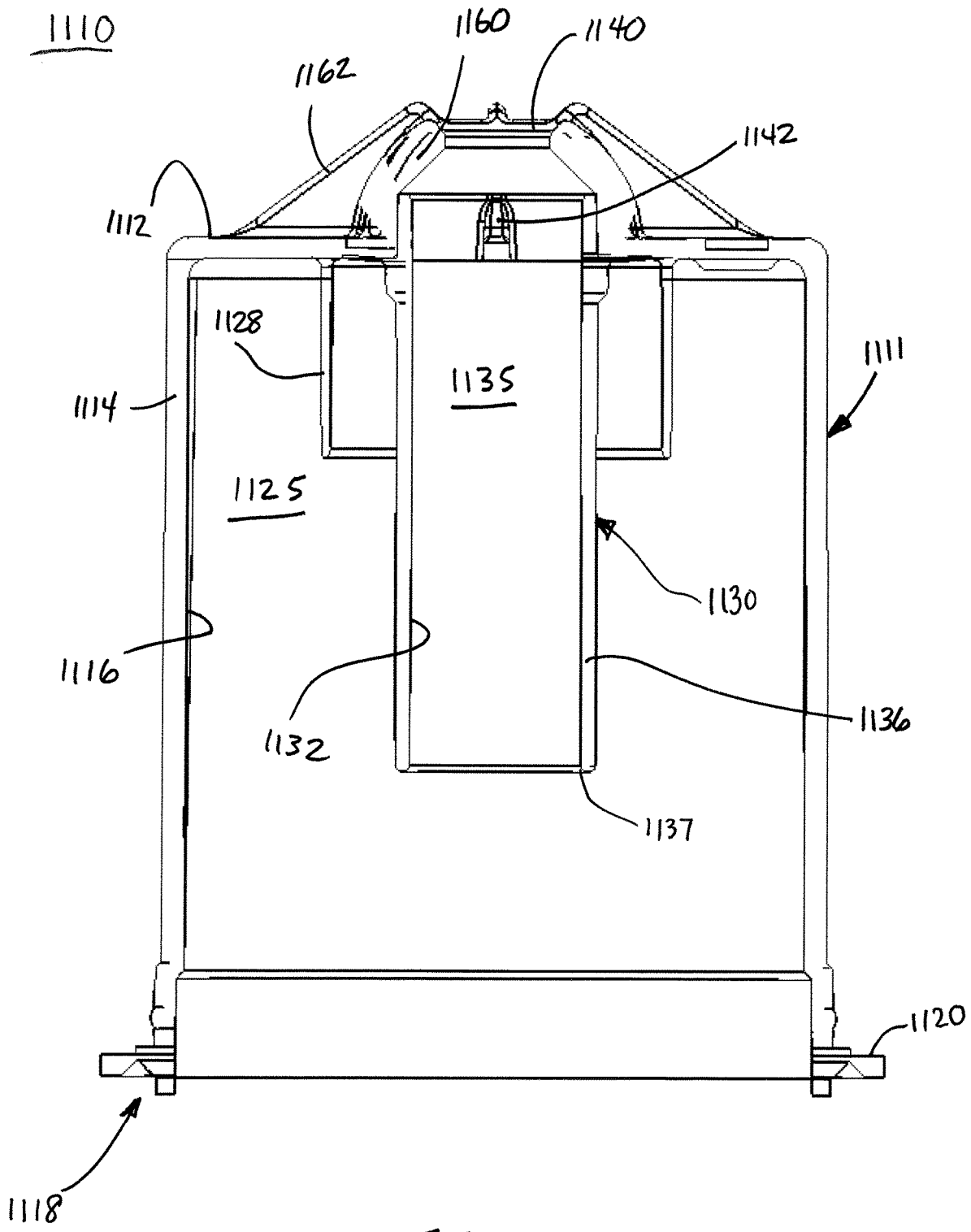
FIG. 21 is a side cross-sectional view of the modular air and liquid dual cup assembly.
Figure 22:
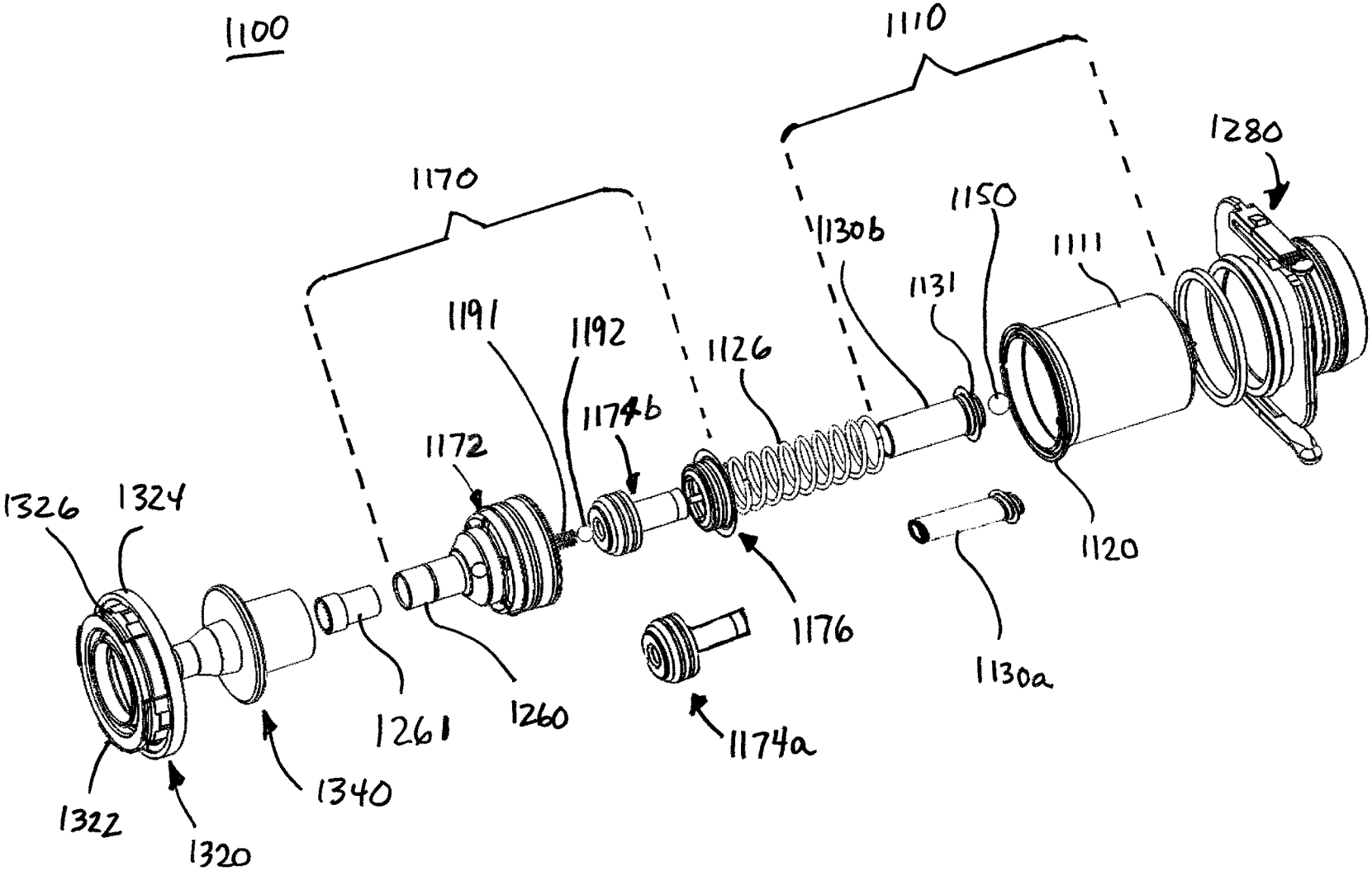
FIG. 22 is an exploded isometric view of the embodiment appearing in FIG. 11.
Figure 23B:
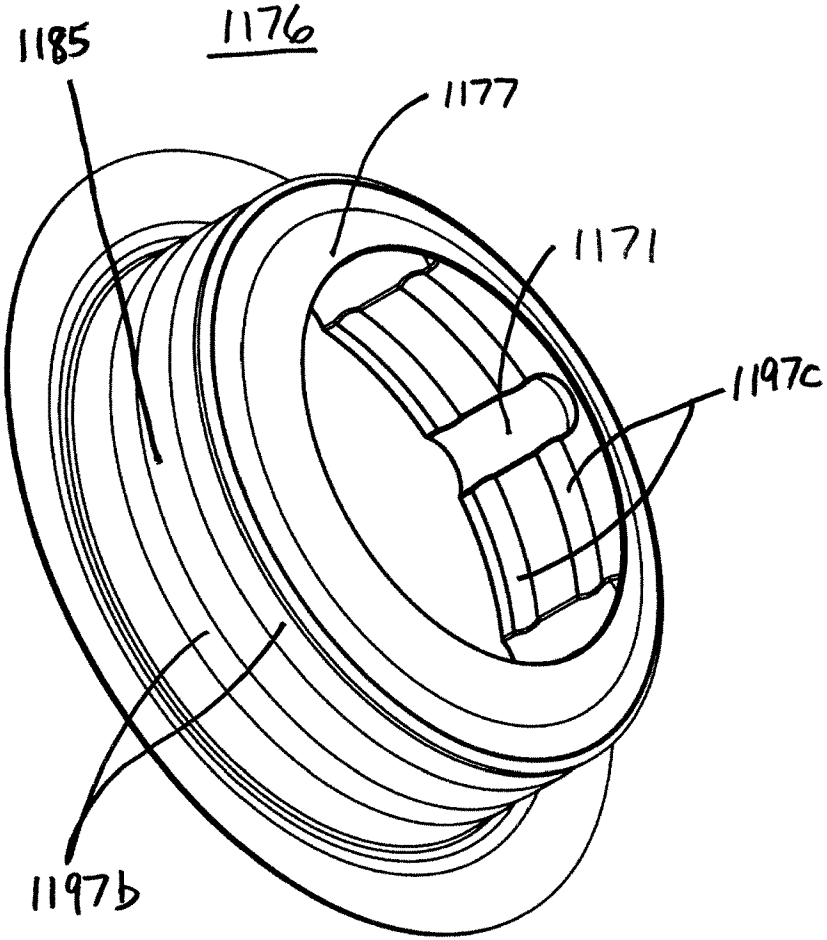
FIG. 23B is an isometric view of the air check valve taken generally from the bottom and side.
Figure 23A:
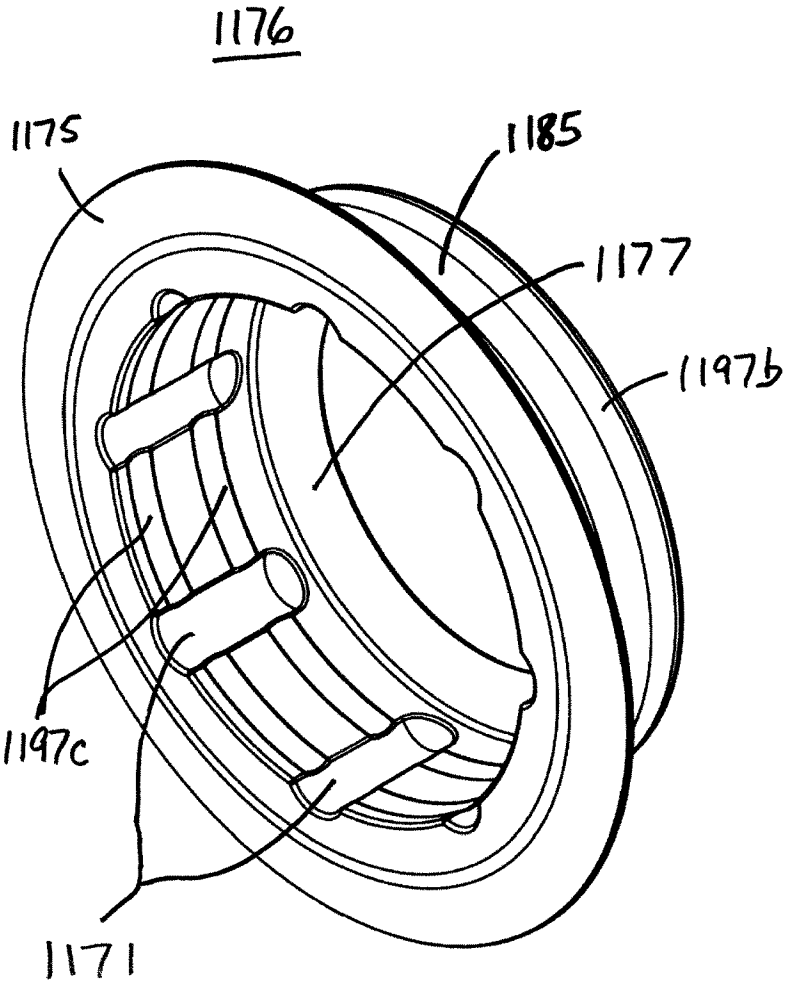
FIG. 23A is an isometric view of an air check valve taken generally from the top and side.
Figure 24B:
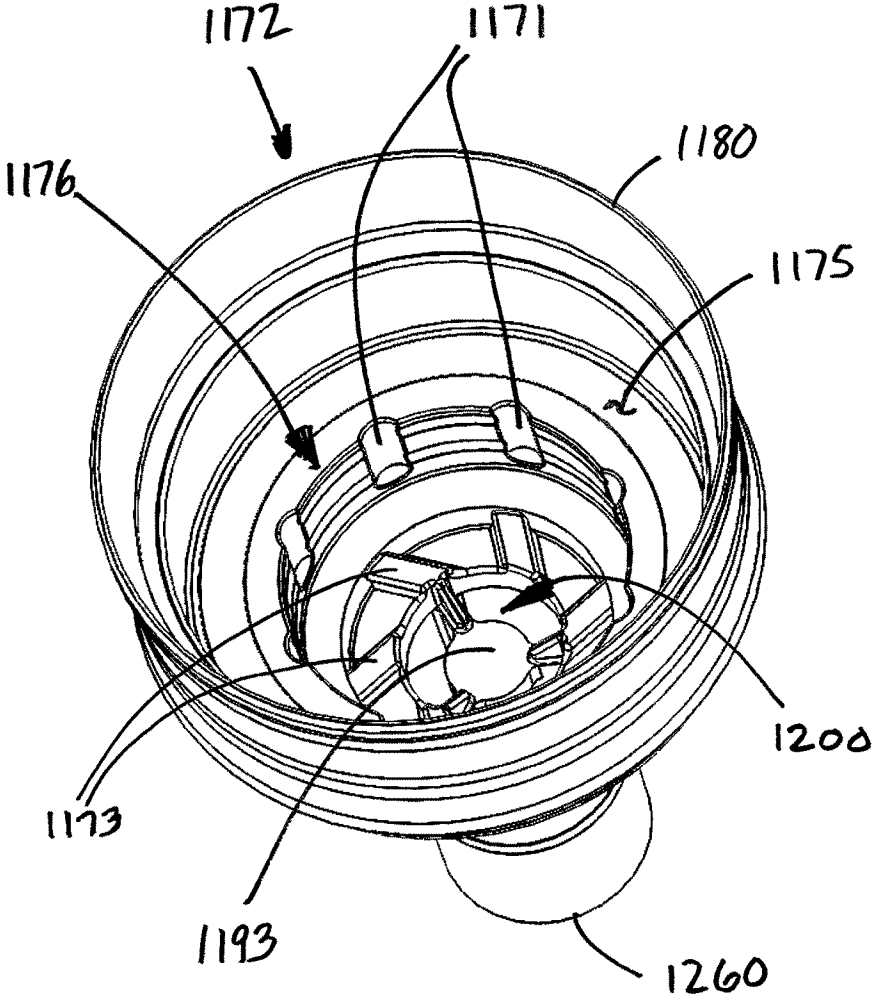
FIG. 24B is an isometric view of the air cup member in combination with the air check valve taken generally from above.
Figure 24A:
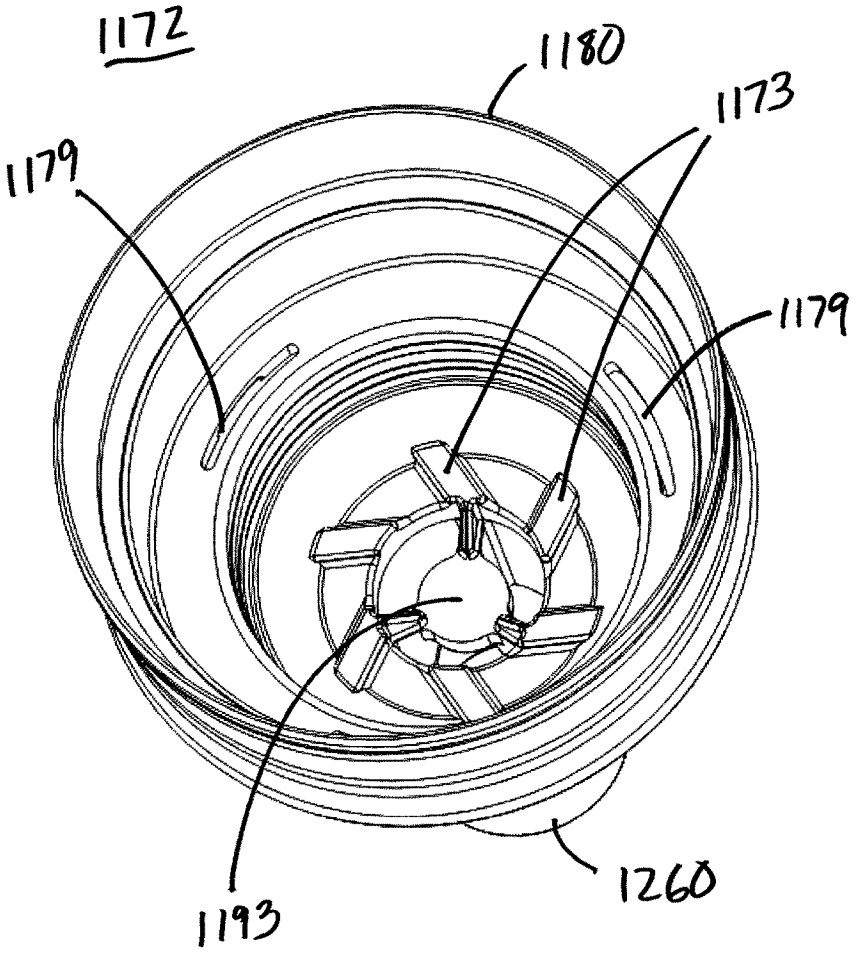
FIG. 24A is an isometric view of the air cup member in combination with the air check valve taken generally from above.
Figure 25:
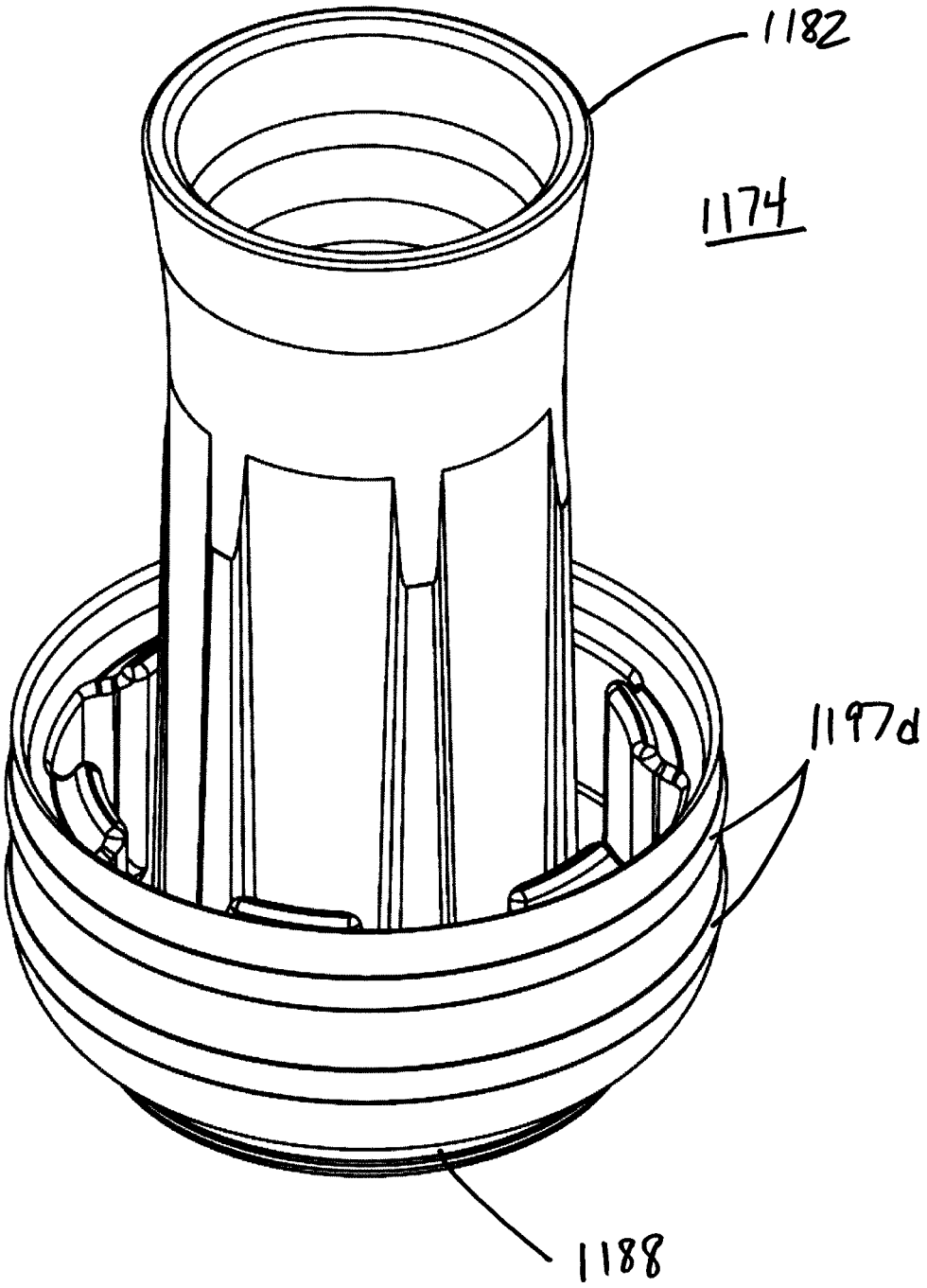
FIG. 25 is an enlarged isometric view of the liquid piston taken generally from the side and below.
Figure 26:
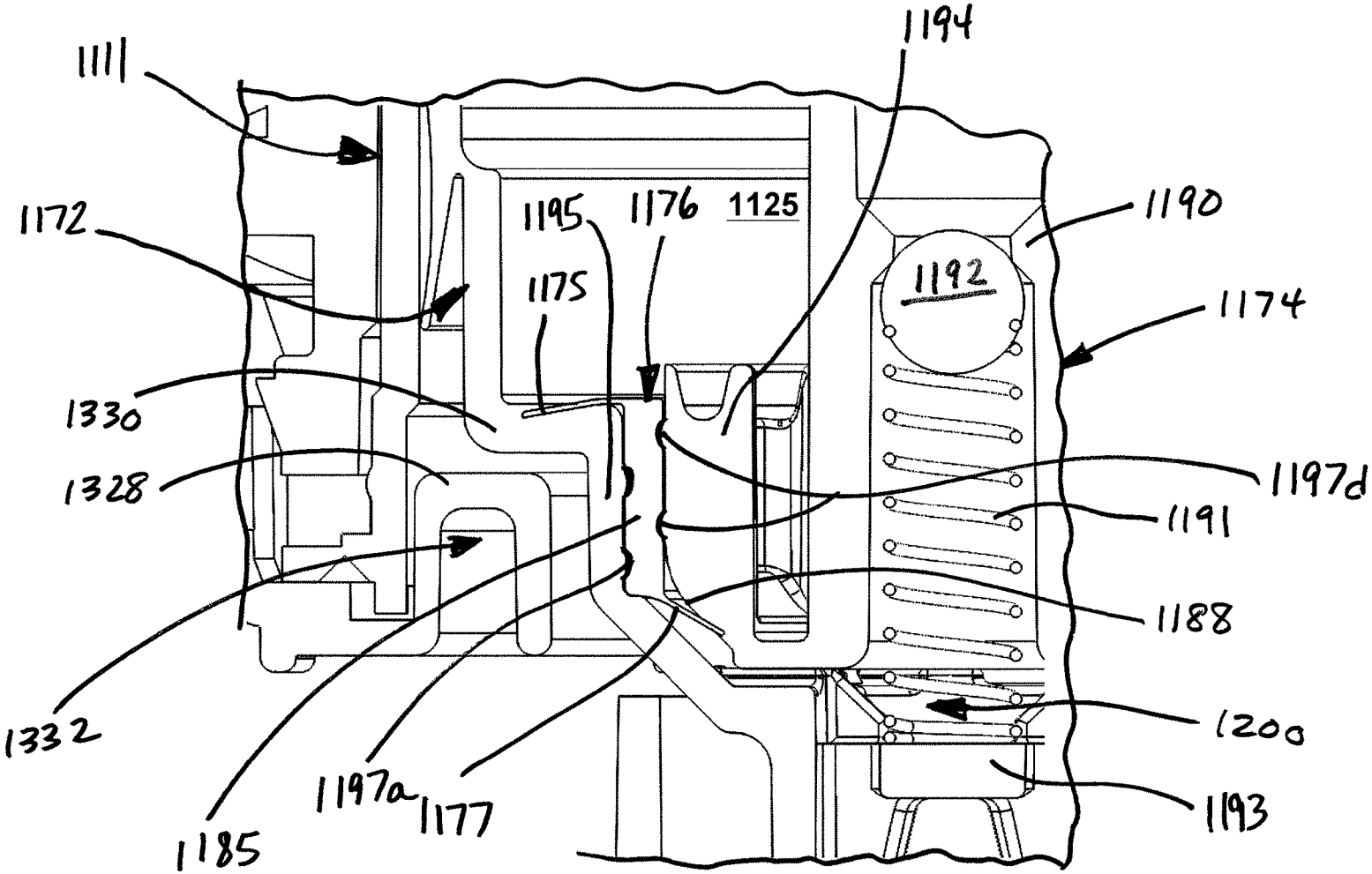
FIG. 26 is a fragmentary side-cross-sectional view illustrating the air flow pathways.

The liquid cup 1130 includes an annular wall 1136 extending downward from the proximal end 1131 and is open at the distal end 1137. The liquid cup 1130 is concentric with respect to the outer annular wall 1114. The liquid cup wall 1136 has an inward facing surface 1132. The liquid cup 1130 defines a liquid cylinder or chamber 1135. In certain embodiments, a plurality of interchangeable liquid cups 1130 are provided which have different volumes, e.g., wherein the volume is determined by the diameter of the annular wall 1136. For example, FIGS. 14 and 15 show an embodiment wherein a first, smaller liquid cup **1130*a* is secured within the air cup 1111 and FIGS. 17 and 18 show an embodiment wherein a second, larger liquid cup 1130*b* is secured within the air cup 1111. Although two differently sized liquid cups 1130*a*, 1130*b* are shown for illustration purposes, it will be recognized that any other number of differently sized air cups may be provided. For example, in certain embodiments, 2, 3, 4, 5, 6, 7, 8, 9, 10, or more, differently sized liquid cups may be provided to be used interchangeably with a common air cup 1111**, e.g., in accordance with a desired foam dose size.

In the illustrated preferred embodiment, the liquid chamber does not extend beyond the axial extent of the air chamber. Because the liquid chamber does not protrude from the air chamber, a low profile pump can be provided, which is especially advantageous for inverted applications where the liquid source e.g., a container or reservoir containing the liquid, is positioned above the pump and it is desirable for the liquid pump inlet to communicate with the liquid located at or near the bottom of the container or reservoir.

A coaxial spring 1126, e.g., a coil spring in the illustrated embodiment, is received within the air chamber 1125 and surrounds the liquid cup 1130. The upper end of the spring is received within a spring seat defined by the upper surface 1112 and an intermediate annular wall 1128 coaxially disposed intermediate the liquid cup wall 1136 and the outer annular wall 1114.

An aperture 1140 defines a liquid inlet to allow a liquid product to pass from a liquid source, such as an attached bag 1300 (se FIG. 27). A check ball 1150 having a diameter larger than the diameter of the aperture 1140 provides a one-way check valve function to prevent liquid that is in the liquid chamber 1135 from passing back into the bag 1300 during a dispensing operation, while allowing liquid to pass from the liquid source 1300 into the chamber 1135 after a dispensing operation. A plurality of ball retention arms 1142 are disposed at the proximal end of the liquid cup 1130 and extend radially inward to retain the check ball 1150 from the bottom. The aperture 1140 is bounded by a wall 1162 defining a check ball cavity receiving the check ball 1150. In certain embodiments, the liquid inlet ball check valve may be replaced with the liquid inlet valve configuration as described above by way of reference to the embodiment appearing in FIGS. 1-10.

In operation, a dispensing cycle includes a dispensing portion and a fill portion. During the dispensing portion, air and liquid are simultaneously forced out of the chambers 1125 and 1135, respectively. During the fill portion, the foamable liquid is drawn from a liquid source, e.g., a liquid container or reservoir such as flexible bag 1300 (see FIG. 27), into the chamber 1135 and ambient air is drawn into the chamber 1125. During the initial, dispensing portion when there is increased pressure within the liquid chamber, the check ball 1150 bears against the aperture 1140 and provides a sealing interference to prevent liquid in the liquid chamber 1135 from exiting the chamber and passing back into the liquid container or reservoir 1300 through the aperture 1140.

During the fill portion of a dispensing cycle, responsive to a decrease in pressure in the liquid chamber 1135, the check ball 1150 moves downward to allow liquid to pass from the bag or reservoir 1300 into the liquid chamber 1135 by passing through the aperture 1140 and around the ball 1150.

Upstanding features such as radial ribs 1160 may be formed on the upper surface 1112 to protect the liquid inlet from interference with the liquid container, such as the flexible bag 1300, as it collapses when liquid 1304 in the reservoir is withdrawn. By holding the collapsing bag off the liquid inlet, the ribs 1160 allow for continued product evacuation as the bag volume decreases around the pump. The ribs 1160 also improve the structural rigidity of the upper surface 1112 and the check ball cavity wall 1162.

A dual piston assembly 1170 is received within the open end 1118 of the air cylinder 1111. The dual piston assembly 1170 includes an air piston member 1172 and a liquid piston assembly 1174, which includes a liquid outlet check ball 1192 and a liquid outlet check valve spring 1191.

The air piston member 1172 includes an upper, open end 1178 having a sealing surface 1180, which may be piston ring, attached thereto. The sealing ring 1180 is dimensioned to make sliding and sealing contact with the inner surface 1116 of the outer wall 1114. The liquid piston assembly 1174 includes a liquid sealing surface, i.e., liquid sealing member or piston ring, 1182 received within the liquid chamber 1135 and sized to slidingly and sealingly engage the inner surface 1132 of the inner annular wall 1130.

In certain embodiments, wherein a plurality of interchangeable. differently-sized liquid cups 1130 are provided to provide a desired dosage size as described above, a plurality of differently-sized, interchangeable liquid piston members 1174 are, likewise, provided. For example, FIGS. 14 and 15 show an embodiment wherein a first, smaller liquid piston 1174*a* is secured to the air piston 1172 and FIGS. 17 and 18 show an embodiment wherein a second, larger liquid piston 1174*b* is secured to the air piston 1172. Although two differently sized liquid pistons 1174*a*, 1174*b* are shown for illustration purposes, it will be recognized that any other number of liquid pistons may be provided; for example, in certain embodiments, 2, 3, 4, 5, 6, 7, 8, 9, 10, or more differently sized liquid pistons may be provided, i.e., which correspond in size to each different size of liquid cup provided.

The liquid piston ring 1182 is disposed on or at the upper, open end 1184 of the liquid piston assembly 1174, although the liquid piston sealing surface could positioned at another position on the liquid piston body and/or could be a separately formed piston ring member as described above. The liquid piston member 1174 defines a passageway or conduit 1186. An annular protrusion 1190 within the piston assembly 1174 defines a valve seat cooperating with the liquid outlet check ball 1192. The valve seat 1190 and the check ball 1192 cooperate to define a one-way or non-return liquid outlet valve. The spring 1191 is retained within the conduit 1186, downstream of the ball 1192 and the valve seat 1190. Although a coil spring is illustrated, other types of springs or other resilient members are contemplated. The spring 1191 is retained within the conduit 1186 by a spring retainer 1193 formed within the air piston member 1172. The spring retainer 1193 defines a perforated baffle providing a resistive pathway for the generated foam to flow through.

The lower end 1188 of the liquid piston assembly 1174 also includes an upstanding annular wall 1194 defining a spring seat 1196 for receiving the lower end of the spring member 1126. In certain embodiments, the liquid outlet ball check valve may be replaced with the liquid outlet valve configuration as described above by way of reference to the embodiment appearing in FIGS. 1-10.

In operation, during the dispensing portion of a dispensing cycle, pressure within the liquid chamber 1135 increases, which urges the check ball 1192 away from the valve seat 1190, compressing the spring 1191. The liquid in the chamber 1135 flows through the conduit 1186, around the check ball 1192, and into a mixing chamber or mixing region 1200 defined in the air piston member 1172. During the fill portion of a dispensing cycle, responsive to reduction in pressure in the liquid chamber 1135, the spring 1191 causes the check ball 1192 to return to a sealing engagement with the liquid outlet valve seat 1190 to prevent liquid from flowing through the passage 1186

In certain embodiments, the spring force of the spring 1191 is selected to provide a desired threshold or cracking pressure necessary to unseat the check ball 1192 from the valve seat 1190. Once the valve is open, the spring force of the spring 1191 provides a closing force or pressure, which defines a threshold pressure below which the valve will move from the open position to the closed or seated position. In operation, once the pressure in the liquid chamber 1135 falls below the threshold closing pressure, the check ball 1192 returns to sealing engagement with the valve seat 1190 to prevent liquid from flowing through the passage 1186.

It has been found that it is possible for the dual cylinder assembly 1110 and the dual piston assembly 1170 to stick partway through a dispensing operation wherein the dual piston assembly 1170 fails to return completely to the non-actuated or home position, e.g., due to stiction/friction between the assemblies 1110, 1170, due to the application of off-axial forces to the piston assembly 1170, etc. In certain embodiments, the cracking pressure and/or closing pressure of the liquid outlet valve is selected such that the ball 1192 will return to sealing engagement with the valve seat 1190 to thereby prevent leaking through the liquid outlet valve once the pressure of the liquid in the liquid chamber 1135 falls below the valve closing pressure, independently of the position of dual piston assembly 1170 in relation to the cylinder assembly 1110. That is, because the liquid outlet valve is biased toward the closed or sealed position with a closing (spring) pressure, the liquid outlet valve does not require a subsequent volume increase in the liquid chamber following a dispensing operation in order to close, but rather, only requires the outwardly directed flow pressure exerted by the collapsing liquid chamber volume to fall below the closing pressure threshold of the spring biased valve check ball 1192 against the valve seat 1190.

During a dispensing cycle, the dispensing portion is initiated by upward movement of the air piston member 1172 together with the liquid piston assembly 1174, e.g., by manually moving the air piston member 1172 and the liquid piston assembly 1174 against the urging of the spring 1126 using a dispensing lever 1364 (see FIG. 27) on the dispenser 1310. As the air piston member 1172 moves upward, air in the chamber 1125 is forced through channels or passageways 1171 between the air piston member 1172 and the liquid piston assembly 1174 to direct air from the air chamber 1125 into mixing region 1200.

As best seen in FIGS. 24A-26, axial air directing channels or passageways 1171 may be as described above and may include air directing or turbulence producing members or vanes 1173 in the air flow pathway to create rotational movement of air entering the mixing region 1200 and increase turbulent mixing of the air and liquid in the mixing region, as described above.

The foam in the mixing region 1200 passes through the perforated baffle 1193 to a foam outlet passageway 1260. A net holder 1261 having a bore coaxial with the passageway 1260 is disposed within the foam outlet 1260, e.g., retained therein via friction fit, snap fit, press fit, etc. The net holder 1260 includes one or more nets or screens 1262 (e.g., one net or screen 1262 at each axial end of the holder 1262 in the illustrated embodiment) to create a generally uniform air bubble size in the foam.

During the fill portion of the dispensing cycle, as the dual piston assembly 1170 moves downward at the urging of the spring member 1126, liquid enters the chamber 1135 via the liquid inlet check valve 1150, as detailed above. In certain embodiments, during the fill portion of the dispensing cycle, ambient air enters the air chamber 1125 through the mixing region 1200 and the passageways connecting the mixing region and the air chamber as described above for the embodiment appearing in FIGS. 1-6.

In certain embodiments, a separate pathway is provided for ambient air to enter the chamber 1125 during the fill portion of a dispensing cycle. In the illustrated embodiment of FIGS. 11-27, an air check valve 1176 is provided between the air piston member 1180 and the liquid piston member 1174. The air check valve 1176 includes a one-way air inlet valve flap member 1175 which permits ambient air to enter the chamber 1125 during the fill portion of the dispensing cycle while blocking ambient air from entering the air chamber 1125 during the dispensing portion of the dispensing cycle. The air check valve 1176 also includes a one-way air outlet valve flap member 1177 which permits air within the air chamber 1125 to exit the air chamber through the air passages 1171 during the dispensing portion of the dispensing cycle while blocking ambient air from entering the air chamber 1125 through the passages 1171 the during the fill portion of the dispensing cycle.

It will be recognized that in certain embodiments, the air check valve member 1176 can be omitted and air ingress and egress into and out of the air chamber 1125 may be through the same pathway, as described above.

In the illustrated embodiment, the return air valve 1176 comprises a generally cylindrical body 1185 disposed between the upstanding annular wall 1194 of the liquid piston assembly 1174 and an aligned wall 1195 of the air piston. In certain embodiments, pressure ribs 1197*a*, or other fastening means such as complementary interlocking features or the like are provided on the inward facing surface of the air piston that is aligned with and contacting the outward facing surface of the valve cylindrical body 1185, and which engage complementary annular grooves 1197*b* formed on the outward facing surface of the cylindrical body 1185. Similarly, in certain embodiments, pressure ribs 1197*d*, or other fastening means such as complementary interlocking features or the like are provided on the outward facing surface of the liquid piston annular wall 1194 that is aligned with and contacting the inward facing surface of the cylindrical body 1185, and which engage complementary annular grooves 1197*c* formed on the inward facing surface of the cylindrical body 1185. In such embodiments, the valve body 1185 provides an interlocking engagement between the air piston 1172 and the liquid piston 1174 and allows them to move together during a dispensing cycle. In certain embodiments, other fasteners may be employed for securing the air piston to the liquid piston while providing an air passage therebetween.

A first annular flap valve 1175, extends outwardly from the upper end of the valve body 1185 and is disposed over one or more perforations 1179 in the air piston 1172. A second annular flap valve 1177, extends inwardly from the lower end of the valve body 1185 and provides a selective sealing engagement with the lower end 1188 of the liquid piston 1174.

In operation, during the dispensing portion of a dispensing cycle, increased pressure in the chamber 1125 seals the flap 1175 against the opening(s) 1179, thereby preventing air in the chamber 1125 from exiting through the opening(s) 1179. The increased pressure thereby forces air to exit the chamber 1125 through the channels 1171 formed in the interior surface of the valve 1176 cylindrical body 1185 and into the mixing region 1200.

During the fill portion of a dispensing cycle, decreased pressure in the air chamber 1125 allows the flap 1175 to move away from the openings 1179, thereby allowing ambient air to enter the chamber 1125 therethrough for the next dispensing cycle, while at the same time the flap 1177 seals against the lower surface 1188 to prevent ambient air from entering the air chamber 1125 through the mixing region 1200 and the passages 1171.

With reference to now to FIGS. 11, 12, 16, 22, and 27, an adapter sleeve 1280 defines a central opening coaxially receiving the dual cylinder assembly 1110. The adapter sleeve 1280 includes a lower end 1282 engaging a sealing ring 1284 such as an O-ring or gasket which in turn engages the flange 1120 on the air cylinder 1111. The adapter sleeve 1280 includes an upper end 1286 configured to be received within a fitment 1302 of a flexible bag 1300 defining a reservoir containing a foamable liquid 1304 which may be of the type suitable for use in a so-called bag-in-box type dispenser. The upper end 1286 may include a barb 1288 and one or more pressure ribs 1290 for securing the upper end 1286 within the fitment and for providing a fluid tight seal therebetween. The adapter sleeve 1280 further includes an intermediate portion 1292 intermediate the upper and lower ends and configured to engage a complementary receptacle or nest 1312 within the dispenser 1310. The dispenser 1310 and adapter sleeve 1280 may be as shown and described in the aforementioned U.S. Pat. No. 8,336,740.

An adapter ring 1320 encircles the lower end 1282 of the adapter sleeve 1280 and the flange 1120 of the air cup 1111. The adapter ring 1320 includes an upper ring 1322 engaging the lower end 1282 and a lower ring 1324 engaging the flange 1120. A plurality of connecting arms 1326 attaches the upper ring 1322 to the lower ring 1324. The lower ring 1324 also includes an annular stop 1328 which extends radially inward of the open end 1118 of the air cylinder 1111 which limits the downward extent of axial movement of the dual piston assembly 1170 relative to the dual cylinder 1110 and prevents the dual piston assembly 1170 from disengaging from the dual cylinder 1110. The adapter ring 1320 may be as shown and described in the aforementioned U.S. Pat. No. 8,336,740.

In the illustrated embodiment, the air piston member 1172 includes a counter bore 1330 which defines a shoulder engaging the stop 1328. The upper and lower rings 1322, 1324 are preferably spaced apart in the axial direction by a distance which provides a clamping force on the lower end 1282, the sealing ring 1284 and the flange 1120 to provide secure retention of the foam pump assembly 1100 and to prevent leakage of any liquid that may pass between the upper end 1286 and the outer wall 1114 of the air cylinder 1111. The stop 1328 may be configured with an annular groove 1332 defining a spring seat for receiving the upper end of an auxiliary spring member 1334.

A nozzle 1340 includes an inner cylindrical wall 1342 receiving the foam passageway 1260, which may be secured therein, e.g., via a press fit or snap fit connection. The nozzle 1340 also includes a dispensing outlet portion 1344 downstream of the inner cylindrical wall 1342.

A flange 1350 extends radially outwardly at a position on the nozzle 1340 intermediate the inner cylindrical wall 1342 and the dispensing outlet portion 1344. An outer cylindrical wall 1346 is coaxial with respect to the inner cylindrical wall 1342 and extends upwardly from the flange 1350. Optionally, the auxiliary spring member 1334 may be provided around the outer wall 1344, with an upper end received within the spring seat 1332 and a lower end bearing against the flange 1350 to provide an additional downward biasing force to urge the dual piston assembly 1170 to the home position. The spring member 1334 may be provided in addition to the spring 1126 or as an alternative thereto.

The foam pump assembly 1100 may advantageously be used in a dispenser 1310 of the type appearing in FIG. 27. The dispenser includes a housing 1360 which may include a pivoting front cover 1362 for providing easy access to the interior of the dispenser to remove spent pump/bag assemblies and install new pump/bag assemblies. The dispenser 1310 may be as shown and described in the aforementioned U.S. Pat. No. 8,336,740.

The dispenser includes a lever 1364 pivotally mounted within the dispenser at a pivot point 1366. The lever 1364 includes a push bar 1368, which is manually actuated by the user during operation and a lever arm 1370 engaging the lower surface of the flange 1350. Inward pressing of the push bar 1368 by the user causes upward movement of the dual cylinder assembly 1170 corresponding to the dispensing portion of the dispensing cycle. Upon release of the push bar 1368, the spring member 1126 and/or spring member 1334 urge the dual cylinder assembly 1170 downward back to the home position, corresponding to the fill portion of the dispensing cycle, wherein air and liquid are drawn into their respective chambers to await the next dispensing operation. A latch 1372 on the pivoting cover 1362 releasably engages a catch 1374 on the housing 1360 to secure the pivoting cover in the closed position.

It will be recognized that the depicted dispensers are exemplary only and that the foaming dispenser pumps herein may be used in connection with all manner of dispensers. Although the present foam pump dispensers are especially advantageous for use in an inverted orientation such as a bag-in-box dispenser wherein the liquid to be dispensed is disposed above the pump because of their low profile and ability to prevent leaks when used in an inverted orientation, it will be recognized that the foam pumps herein may also be adapted for use in noninverted applications such as a countertop container having rigid walls or other container wherein the pump is mounted above the liquid source and wherein a dip tube is used to communicate with the bottom of the container.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A foam pump apparatus, comprising:

a) a dual air and liquid cylinder assembly including:

i) an air cup having a base wall and an outer annular wall extending from the base wall, the outer annular wall having an open end opposite the base wall;

ii) a liquid cup having a proximal end, an inner annular wall extending from the proximal end, and a distal end opposite the proximal end, the distal end being open, the liquid cup and the air cup being separately formed, and the proximal end configured to be attached to a complementary fastener element on the base wall to coaxially secure the liquid cup within the air cup;

iii) a first aligned opening in the base wall and a second aligned opening in the proximal end cooperating to define a liquid inlet; and iv) a first liquid check valve for regulating a flow of foamable liquid from a liquid source to the liquid cup;

b) a dual air and liquid piston assembly received in said dual air and liquid cylinder assembly, said dual air and liquid piston assembly including:

i) an air piston member including an air sealing surface slidably engaging an inner surface of said outer annular wall, the air piston member cooperating with the base wall and the outer annular wall to define an air chamber for receiving air, the air chamber being selectively collapsible in response to relative movement between the dual air and liquid piston assembly and the dual air and liquid cylinder assembly in a first axial direction and expandable in response to relative movement between the dual air and liquid piston assembly and the dual air and liquid cylinder assembly in a second axial direction;

ii) a liquid piston member including a liquid sealing surface slidably engaging an inner surface of said inner annular wall, the liquid piston member cooperating with the proximal end and the inner annular wall to define a liquid chamber for receiving a foamable liquid, the liquid chamber being selectively collapsible in response to relative movement between the dual air and liquid piston assembly and the dual air and liquid cylinder assembly in the first axial direction and expandable in response to relative movement between the dual air and liquid piston assembly and the dual air and liquid cylinder assembly in the second axial direction;

iii) the liquid piston member having a first end defining a liquid piston inlet and a second end defining a liquid piston outlet, and a central passageway extending between the first end and the second end, the liquid piston member attached to the air piston member to move together therewith; and iv) a second liquid check valve for regulating a flow of the foamable liquid through the central passageway;

c) the dual air and liquid piston assembly including a mixing region downstream of the liquid piston outlet, wherein the mixing region is in fluid communication with the liquid chamber when the second liquid check valve is in an open position;

d) the mixing region in fluid communication with the air chamber through one or more air passageways extending between the air piston member and the liquid piston member; and e) a biasing member urging said dual air and liquid piston assembly to a non-actuated position, wherein the foam pump is actuatable by urging said piston assembly against said biasing member to an actuated position in which said air chamber and said liquid chamber are reduced in volume such that air is expelled from said air chamber and through said one or more air passageways into the mixing region while at the same time foamable liquid is expelled from the liquid chamber through said central passageway, wherein simultaneous movement of the air and the foamable liquid into the mixing region is configured to cause a turbulent mixing thereof in the mixing region, and (f) one or more alternate liquid cups, wherein the one or more alternate liquid cups are interchangeably attachable to the fastener element in place of said liquid cup and wherein at least one of the one or more alternate liquid cups has a volume which is different from a volume of said liquid cup.

2. The foam pump apparatus of claim 1, wherein the proximal end of the liquid cup is removably attached to the fastener element on the base wall of the air cup.

3. The foam pump apparatus of claim 1, wherein the fastener element comprises a receptacle formed on the base wall configured to receive the proximal end of the liquid cup.

4. The foam pump apparatus of claim 1, further comprising one or more alternate liquid piston members wherein each of the one or more alternate liquid piston members is attachable to a corresponding one of said one or more alternate liquid cups.

5. The foam pump apparatus of claim 1, further comprising:

one or more air inlet openings formed in the air piston member; and an air check valve member having a first sealing element selectively engaging the one or more air inlet openings, the first sealing element configured to permit ambient air to flow into the air chamber during a fill portion of a dispensing cycle when the air chamber is expanding and to prevent ambient air from flowing into the air chamber through said one or more air inlet openings during a dispensing portion of a dispensing cycle when the air chamber is collapsing.

6. The foam pump apparatus of claim 5, wherein said air check valve member further includes a second sealing element selectively engaging the liquid piston member, the second sealing element configured to permit air within the air chamber to flow through the plurality of passageways into the mixing region during the dispensing portion of the dispensing cycle when the air chamber is collapsing and to prevent ambient air from flowing into the air chamber through the plurality of air passageways during the fill portion of a dispensing cycle when the air chamber is expanding.

7. The foam pump apparatus of claim 1, wherein the plurality of air passageways is configured to impart a rotational flow to air entering the mixing region.

8. The foam pump apparatus of claim 1, wherein the liquid chamber has an axial extent which does not extend beyond an axial extent of the air chamber.

9. The foam pump apparatus of claim 1, wherein the biasing member is a coil spring surrounding the inner annular wall, the coil spring having a first end engaging the base wall and a second end opposite the first end, the second end engaging the dual air and liquid piston assembly.

10. The foam pump apparatus of claim 1, wherein:

the first liquid check valve member is configured to close responsive to increased pressurization of the liquid chamber during a dispensing portion of a dispensing cycle and to open responsive to decreased pressurization of the liquid chamber during a fill portion of a dispensing cycle; and the second liquid check valve member is configured to open responsive to increased pressurization of the liquid chamber during a dispensing portion of a dispensing cycle and to close responsive to decreased pressurization of the liquid chamber during a fill portion of the dispensing cycle.

11. The foam pump apparatus of claim 1, further comprising a container containing a foamable liquid, the container in fluid communication with the first liquid check valve.

12. The foam pump apparatus of claim 1, wherein the second liquid check valve includes a captured ball biased by a spring to close the liquid outlet, the ball configured to move away from a valve seat and thereby open responsive to increased pressurization of the liquid chamber during a dispensing portion of a dispensing cycle.

13. The foam pump apparatus of claim 1, further comprising:

a plurality of vanes disposed between the plurality of air passageways and the mixing region, the plurality of vanes configured to impart rotational flow to air entering the mixing region.

14. The foam pump apparatus of claim 1, further comprising an adapter sleeve defining a central opening and coaxially receiving said dual air and liquid cylinder assembly, the adapter sleeve including an upper end configured to be received within a fitment of a container for the foamable liquid.

15. The foam pump apparatus of claim 14, wherein the adapter sleeve further comprises an intermediate portion adjacent the upper end, the intermediate portion configured to engage a complementary receptacle within a dispenser housing.

16. The foam pump apparatus of claim 15, wherein the adapter sleeve further comprises a lower end opposite the upper end, the foam dispensing container further comprising an annular sealing member disposed between an external flange on the dual air and liquid cylinder assembly and the lower end.

17. The foam pump apparatus of claim 16, further comprising:

an adapter ring assembly encircling the lower end of the adapter sleeve and the external flange of the dual air and liquid cylinder assembly, the adapter ring including an upper ring engaging the lower end and a lower ring engaging the external flange, wherein a plurality of connecting arms on the upper ring attach the upper ring to the lower ring; and an annular stop extending radially and axially inward of the open end of the dual air and liquid cylinder assembly for limiting the extent of axial movement of the dual air and liquid piston assembly to prevent the dual air and liquid piston assembly from disengaging from the dual air and liquid cylinder assembly.

18. The foam pump apparatus of claim 17, further comprising one or both of a nozzle and screen member in fluid communication with the mixing region.

19. The foam pump apparatus of claim 18, further comprising:

the nozzle and a nozzle flange on the nozzle extending radially outwardly; and optionally, a spring having a first end bearing against the lower ring of the adapter ring assembly and a second end bearing against the nozzle flange.

20. The foam pump apparatus of claim 1, further comprising a container containing the foamable liquid, the container having an opening in fluid communication with the liquid inlet.

21. The foam pump apparatus of claim 20, wherein the foamable liquid is selected from the group consisting of a soap, a shampoo, and a hand sanitizer, a hair mousse, a hair coloring composition, a shaving cream, and a lotion.

22. The foam pump apparatus of claim 20, further comprising a housing receiving the container and an actuator movably mounted on said housing, the actuator in mechanical communication with the dual air and liquid piston assembly and cooperable therewith to dispense the foamable liquid from the container to a location exterior of the housing responsive to movement of the actuator relative to the housing.

23. A dual air and liquid cylinder assembly for a foam pump, comprising:

an air cup having a base wall and an outer annular wall extending from the base wall, the outer annular wall having an open end opposite the base wall;

a first liquid cup having a proximal end, an inner annular wall extending from the proximal end, and a distal end opposite the proximal end, the distal end being open, the first liquid cup and the air cup being separately formed, and the proximal end configured to be attached to a complementary fastener element on the base wall to coaxially secure the first liquid cup within the air cup;

a first aligned opening in the base wall and a second aligned opening in the proximal end cooperating to define a liquid inlet;

a liquid check valve for regulating a flow of foamable liquid from a liquid source to the first liquid cup; and a second liquid cup interchangeably attachable to the fastener element in place of the first liquid cup, the second liquid cup having a volume which is different from a volume of said first liquid cup.

24. A method of configuring a foam pump to dispense a dose of foam having a desired size, the method comprising:

providing a dual air and liquid cylinder assembly including an air cup having a base wall and an outer annular wall extending from the base wall, the outer annular wall having an open end opposite the base wall, the base wall having a fastener element for attaching a separately formed liquid cup, the dual air and liquid cylinder assembly being cooperable with a dual air and liquid piston assembly;

providing the separately formed liquid cup, the separately formed liquid cup having a proximal end, an inner annular wall extending from the proximal end, and a distal end opposite the proximal end, the distal end being open, the proximal end configured to be attached to the fastener element on the base wall, wherein the liquid cup is sized hold a first preselected quantity of a foamable liquid that is sufficient to generate a dose of foam having a first desired size when the foam pump is actuated;

providing an alternate liquid cup, wherein the alternate liquid cup is interchangeably attachable to the fastener element in place of said separately formed liquid cup and wherein the alternate liquid cup is sized to hold a second preselected quantity of the foamable liquid that is sufficient to generate a dose of foam having a second desired size which is different from the first desired size when the pump is actuated; and coaxially securing a selected one of the separately formed liquid cup and the alternate liquid cup to the fastener element within the air cup.

25. A foam pump apparatus, comprising:

a) a dual air and liquid cylinder including:

i) an air cup having a base wall and an outer annular wall extending from the base wall, the outer annular wall having an open end opposite the base wall;

ii) a liquid cup having a proximal end, an inner annular wall extending from the proximal end, and a distal end opposite the proximal end, the distal end being open wherein the liquid cup and the air cup are separately formed, and wherein the proximal end is configured to be attached to a complementary fastener element on the base wall to coaxially secure the liquid cup within the air cup;

iii) a first aligned opening in the base wall and a second aligned opening in the proximal end cooperating to define a liquid inlet; and iv) a first liquid check valve for regulating a flow of foamable liquid from a liquid source to the liquid cup;

b) a dual air and liquid piston assembly received in said dual air and liquid cylinder, said dual air and liquid piston assembly movable in relation to said dual air and liquid cylinder along a flow axis, said dual air and liquid piston assembly including:

i) an air piston member including an air sealing surface slidably engaging an inner surface of said outer annular wall, the air piston member cooperating with the base wall and the outer annular wall to define an air chamber for receiving air, the air chamber being selectively collapsible in response to relative movement between the dual air and liquid piston assembly and the dual air and liquid cylinder in a first axial direction and expandable in response to relative movement between the dual air and liquid piston assembly and the dual air and liquid cylinder in a second axial direction;

ii) a liquid piston member including a liquid sealing surface slidably engaging an inner surface of said inner annular wall, the liquid piston member cooperating with the proximal end and the inner annular wall to define a liquid chamber for receiving a foamable liquid, the liquid chamber being selectively collapsible in response to relative movement between the dual air and liquid piston assembly and the dual air and liquid cylinder in the first axial direction and expandable in response to relative movement between the dual air and liquid piston assembly and the dual air and liquid cylinder in the second axial direction;

iii) the liquid piston member having a first end defining a liquid piston inlet and a second end defining a liquid piston outlet, and a central passageway extending between the first end and the second end, the liquid piston member attached to the air piston member to move together therewith; and iv) a second liquid check valve for regulating a flow of the foamable liquid through the central passageway, the second liquid check valve including a captured ball biased by a coil spring to close the liquid outlet, the ball configured to move away from a valve seat and thereby open responsive to increased pressurization of the liquid chamber during a dispensing portion of a dispensing cycle;

c) the dual air and liquid piston assembly including a mixing region downstream of the liquid piston outlet, wherein the mixing region is in fluid communication with the liquid chamber when the second liquid check valve is in an open position;

d) the mixing region in fluid communication with the air chamber through one or more air passageways extending between the air piston member and the liquid piston member, wherein the plurality of air passageways is configured to impart a rotational flow around the flow axis to air entering the mixing region;

e) a biasing member urging said dual air and liquid piston assembly to a non-actuated position, wherein the foam pump is actuatable by urging said piston assembly against said biasing member to an actuated position in which said air chamber and said liquid chamber are reduced in volume such that air is expelled from said air chamber and through said one or more air passageways into the mixing region while at the same time foamable liquid is expelled from the liquid chamber through said central passageway, wherein simultaneous movement of the air and the foamable liquid into the mixing region is configured to cause a turbulent mixing thereof in the mixing region, and (f) one or more alternate liquid cups, wherein the one or more alternate liquid cups are interchangeably attachable to the fastener element in place of said liquid cup and wherein at least one of the one or more alternate liquid cups has a volume which is different from a volume of said liquid cup.

26. The foam pump apparatus of claim 25, wherein at least a portion of the coil spring extends into the mixing region.

27. A foam pump apparatus, comprising:

a) a dual air and liquid cylinder assembly including:

i) an air cup having a base wall and an outer annular wall extending from the base wall, the outer annular wall having an open end opposite the base wall;

ii) a liquid cup having a proximal end, an inner annular wall extending from the proximal end, and a distal end opposite the proximal end, the distal end being open, the liquid cup and the air cup being separately formed, and the proximal end configured to be attached to a complementary fastener element on the base wall to coaxially secure the liquid cup within the air cup;

iii) a first aligned opening in the base wall and a second aligned opening in the proximal end cooperating to define a liquid inlet; and iv) a first liquid check valve for regulating a flow of foamable liquid from a liquid source to the liquid cup;

b) a dual air and liquid piston assembly received in said dual air and liquid cylinder assembly, said dual air and liquid piston assembly including:

i) an air piston member including an air sealing surface slidably engaging an inner surface of said outer annular wall, the air piston member cooperating with the base wall and the outer annular wall to define an air chamber for receiving air, the air chamber being selectively collapsible in response to relative movement between the dual air and liquid piston assembly and the dual air and liquid cylinder assembly in a first axial direction and expandable in response to relative movement between the dual air and liquid piston assembly and the dual air and liquid cylinder assembly in a second axial direction;

ii) a liquid piston member including a liquid sealing surface slidably engaging an inner surface of said inner annular wall, the liquid piston member cooperating with the proximal end and the inner annular wall to define a liquid chamber for receiving a foamable liquid, the liquid chamber being selectively collapsible in response to relative movement between the dual air and liquid piston assembly and the dual air and liquid cylinder assembly in the first axial direction and expandable in response to relative movement between the dual air and liquid piston assembly and the dual air and liquid cylinder assembly in the second axial direction;

iii) the liquid piston member having a first end defining a liquid piston inlet and a second end defining a liquid piston outlet, and a central passageway extending between the first end and the second end, the liquid piston member attached to the air piston member to move together therewith; and iv) a second liquid check valve for regulating a flow of the foamable liquid through the central passageway;

c) the dual air and liquid piston assembly including a mixing region downstream of the liquid piston outlet, wherein the mixing region is in fluid communication with the liquid chamber when the second liquid check valve is in an open position;

d) the mixing region in fluid communication with the air chamber through one or more air passageways extending between the air piston member and the liquid piston member;

e) a biasing member urging said dual air and liquid piston assembly to a non-actuated position, wherein the foam pump is actuatable by urging said piston assembly against said biasing member to an actuated position in which said air chamber and said liquid chamber are reduced in volume such that air is expelled from said air chamber and through said one or more air passageways into the mixing region while at the same time foamable liquid is expelled from the liquid chamber through said central passageway, wherein simultaneous movement of the air and the foamable liquid into the mixing region is configured to cause a turbulent mixing thereof in the mixing region;

f) one or more air inlet openings formed in the air piston member; and g) an air check valve member having a first sealing element selectively engaging the one or more air inlet openings, the first sealing element configured to permit ambient air to flow into the air chamber during a fill portion of a dispensing cycle when the air chamber is expanding and to prevent ambient air from flowing into the air chamber through said one or more air inlet openings during a dispensing portion of a dispensing cycle when the air chamber is collapsing;

wherein said air check valve member further includes a second sealing element selectively engaging the liquid piston member, the second sealing element configured to permit air within the air chamber to flow through the plurality of passageways into the mixing region during the dispensing portion of the dispensing cycle when the air chamber is collapsing and to prevent ambient air from flowing into the air chamber through the plurality of air passageways during the fill portion of a dispensing cycle when the air chamber is expanding.

28. The foam pump apparatus of claim 27, wherein the second liquid check valve includes a captured ball biased by a coil spring to close the liquid outlet, the ball configured to move away from a valve seat and thereby open responsive to increased pressurization of the liquid chamber during a dispensing portion of a dispensing cycle.

29. The foam pump apparatus of claim 28, wherein at least a portion of the coil spring extends into the mixing region.

* * * * *